US006737982B2

(12) United States Patent
Slomowitz et al.

(10) Patent No.: US 6,737,982 B2
(45) Date of Patent: May 18, 2004

(54) CRIB GATE POSITION INDICATOR

(76) Inventors: Cynthia J. Slomowitz, 33 Maple La., Glen Mills, PA (US) 19342; Scott M. Slomowitz, 33 Maple La., Glen Mills, PA (US) 19342

( * ) Notice: Subject to any disclaimer, the term of this patent is extended or adjusted under 35 U.S.C. 154(b) by 0 days.

(21) Appl. No.: 10/274,320

(22) Filed: Oct. 18, 2002

(65) Prior Publication Data

US 2003/0038725 A1 Feb. 27, 2003

Related U.S. Application Data

(63) Continuation-in-part of application No. 10/209,135, filed on Jul. 31, 2002, which is a continuation of application No. 09/968,232, filed on Oct. 1, 2001, now Pat. No. 6,433,699, which is a continuation-in-part of application No. 09/843,976, filed on Apr. 27, 2001, now Pat. No. 6,476,724, which is a continuation-in-part of application No. 09/383,176, filed on Aug. 25, 1999, now Pat. No. 6,225,913.

(51) Int. Cl.[7] ..... G08B 21/00

(52) U.S. Cl. ..... 340/686.1; 340/539.15; 340/573.1

(58) Field of Search ..... 340/384.1, 384.7, 340/521, 545.1, 539.15, 573.1, 573.4, 686.1; 381/56, 110

(56) References Cited

U.S. PATENT DOCUMENTS

| | | | |
|---|---|---|---|
| 2,734,104 | A | 2/1956 | Gollhofer |
| 3,641,540 | A | 2/1972 | Cutler, et al. |
| 3,833,895 | A | 9/1974 | Fecteau |
| 3,938,121 | A | 2/1976 | Jamison |
| 4,067,005 | A | 1/1978 | Levy et al. |
| 4,178,645 | A | 12/1979 | Cosme |
| 4,231,030 | A | 10/1980 | Weiss |
| 4,278,968 | A | 7/1981 | Arnett et al. |
| 4,640,267 | A | 2/1987 | Lawson |

(List continued on next page.)

FOREIGN PATENT DOCUMENTS

| | | |
|---|---|---|
| DE | 3034 968 | 9/1980 |
| DE | 3204 827 | 2/1982 |

OTHER PUBLICATIONS

New Study on how to avoid crib injuries to infants and toddlers—M.V. Ridenour, Ph.D., Temple, College of Education.

BABYCOM, Practical Electronics, Nov. 1979 p. 24–27., O.N. Bishop.

*Primary Examiner*—Van T Trieu
(74) *Attorney, Agent, or Firm*—Caesar, Rivise, Bernstein, Cohen & Pokotilow, Ltd.

(57) ABSTRACT

A crib gate position indicator for use with a baby crib having a movable gate that can be placed into an open or a closed position. The crib gate position indicator includes a first portion that is mounted to the moveable gate and a second portion that is mounted to the frame of the crib. One of these two portions wirelessly detects the presence of the other when the moveable gate is closed. When the moveable gate is opened, the non-detection of the other member activates an indicator, visual or audible, at one of those members to alert a nearby caretaker that the crib gate is open. Alternatively, this indicator can be remotely-located and may even include a speaker for also conveying both a crib gate open condition as well as the sounds of the baby in the crib. Several alternatives of non-contact detection are disclosed for these first and second portions. Also, the crib gate position indicator can be applied for use with hospital beds, or doors and gates in general.

122 Claims, 25 Drawing Sheets

U.S. PATENT DOCUMENTS

| | | | | | |
|---|---|---|---|---|---|
| 4,826,262 | A | | 5/1989 | Hartman | |
| 4,924,214 | A | | 5/1990 | Hill | |
| 4,951,032 | A | | 8/1990 | Langsam | |
| 5,022,402 | A | | 6/1991 | Schieberl et al. | |
| 5,057,819 | A | | 10/1991 | Valenti | |
| 5,210,532 | A | | 5/1993 | Knoedler et al. | |
| D336,351 | S | | 6/1993 | Freese et al. | |
| 5,280,635 | A | | 1/1994 | Knoedler et al. | |
| 5,291,181 | A | | 3/1994 | DePonte | |
| 5,365,214 | A | | 11/1994 | Angott et al. | |
| 5,402,105 | A | | 3/1995 | Doyle et al. | |
| 5,499,014 | A | | 3/1996 | Greenwaldt | |
| 5,512,880 | A | | 4/1996 | Abrams et al. | |
| 5,604,478 | A | | 2/1997 | Grady et al. | |
| 5,629,683 | A | | 5/1997 | Slomowitz et al. | |
| 5,689,236 | A | | 11/1997 | Kister | |
| 5,748,074 | A | | 5/1998 | Chomet | |
| 5,757,274 | A | | 5/1998 | Slomowitz et al. | |
| 5,852,411 | A | | 12/1998 | Jacobs et al. | |
| 5,883,579 | A | | 3/1999 | Schreiner et al. | |
| 5,914,660 | A | * | 6/1999 | Meslibow et al. | 340/573.1 |
| 5,973,591 | A | | 10/1999 | Schwartz et al. | |
| 6,084,527 | A | | 7/2000 | Spector | |
| 6,114,963 | A | * | 9/2000 | Blake et al. | 340/573.4 |
| 6,225,913 | B1 | | 5/2001 | Slomowitz et al. | |
| 6,229,455 | B1 | | 5/2001 | Yost et al. | |
| 6,433,699 | B1 | | 8/2002 | Slomowitz et al. | |
| 6,476,724 | B1 | | 11/2002 | Slomowitz et al. | |
| 6,522,259 | B1 | | 2/2003 | Tamura | |

* cited by examiner

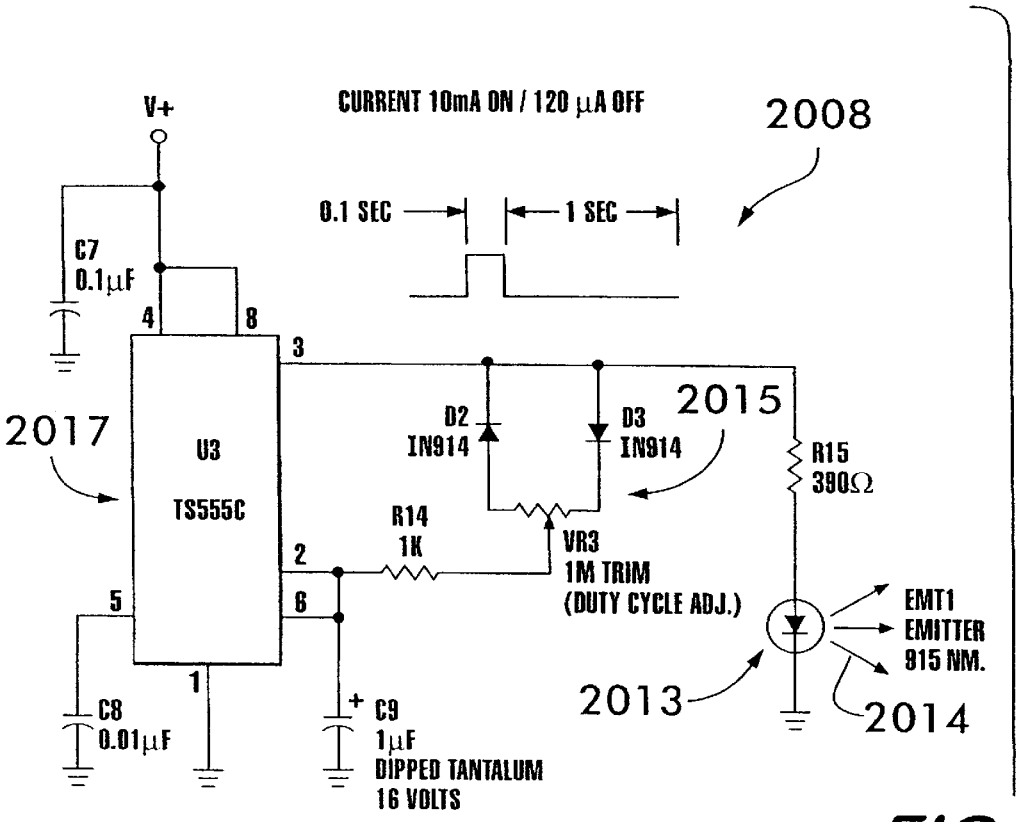
FIG.4A
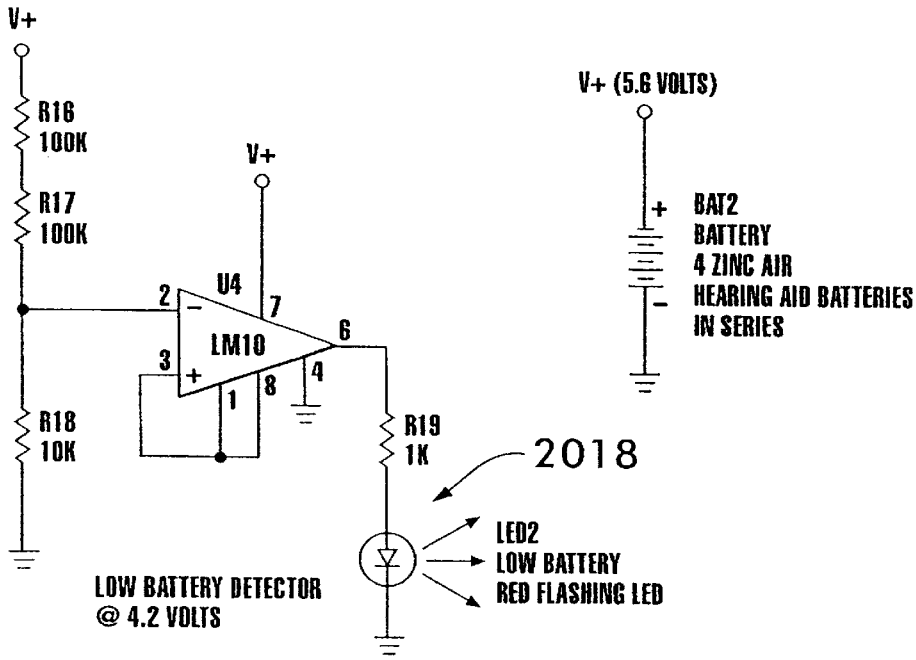

FIG.9
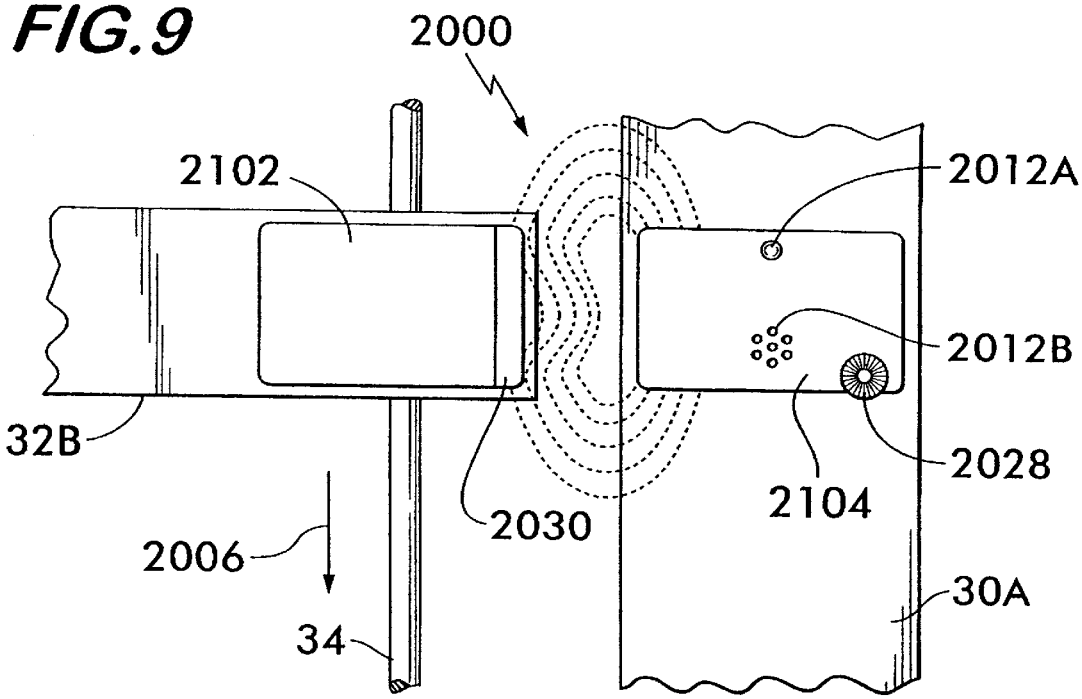
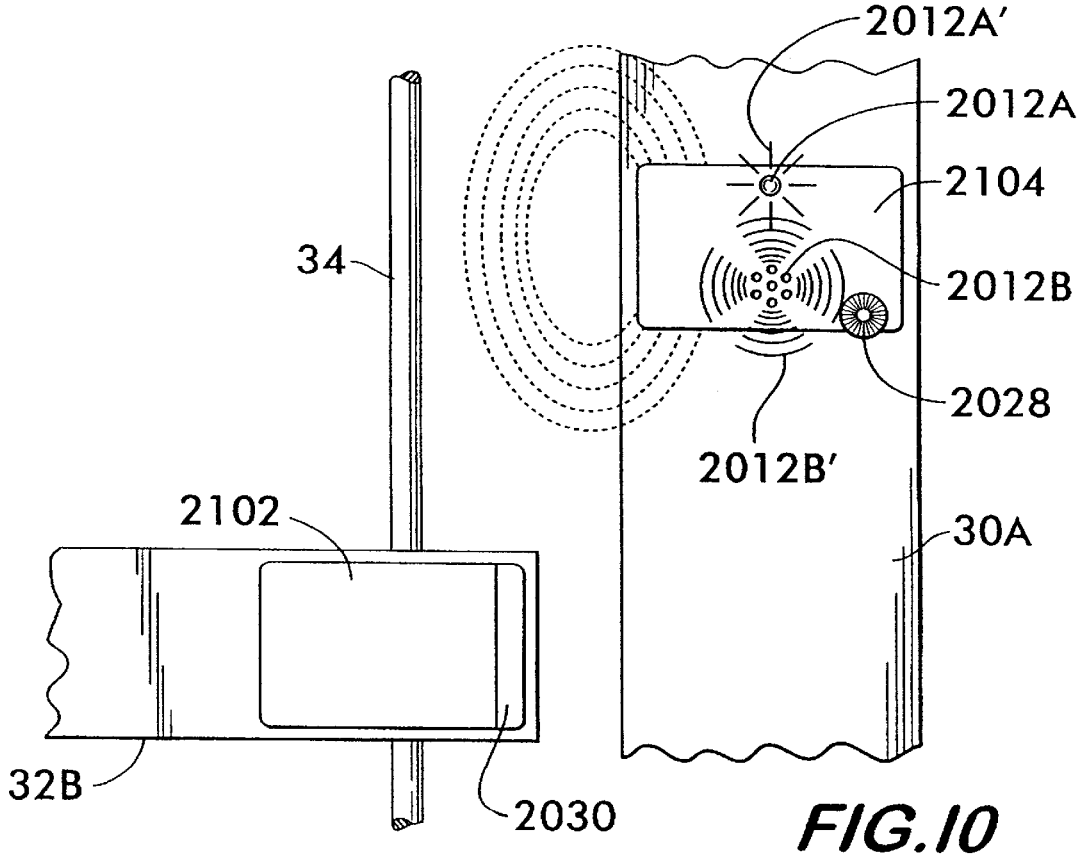
FIG.10

2180A

1180A

1180B

1180A

1180B

CRIB GATE POSITION INDICATOR

SPECIFICATION

RELATED APPLICATIONS

This application is a Continuation-in-Part of Co-Pending Application Ser. No. 10/209,135, filed on Jul. 31, 2002, which is a Continuation of Application Ser. No. 09/968,232, filed on Oct. 1, 2001 (now U.S. Pat. No. 6,433,699), which is a Continuation-in-Part of application Ser. No. 09/843,976 filed Apr. 27, 2001, (now U.S. Pat. No. 6,476,724), which is a Continuation-in-Part of application Ser. No. 09/383,176 filed Aug. 25, 1999 (now U.S. Pat. No. 6,225,913), all of which are entitled CRIB GATE POSITION INDICATOR and all of whose entire disclosures are incorporated by reference herein.

FIELD OF THE INVENTION

This invention relates generally to indicators and, more particularly, to electronic position indicators for the gate of a crib.

BACKGROUND OF THE INVENTION

Most baby cribs comprise a mattress located within a bed frame having four sides, with each side comprising vertical bars positioned between a top molding and a bottom molding. Two opposing sides are vertically displaceable, known as a crib gate, in either a raised (closed) condition or in a lowered (open) position. Lowering the gate is accomplished by displacing a footbar (located at the bottom and just under the bottom molding) which disengages a bottom molding catch from the footbar and then allows the gate to drop downward. Raising the gate is accomplished by simply lifting the gate upwards until the bottom molding catch re-engages the footbar, thereby locking the gate in a raised position.

In most instances, the parent or infant-caretaker will be holding or rocking the baby to sleep. When the parent or infant-caretaker is ready to place the baby on the mattress, the gate is lowered as discussed previously. Usually, the parent or infant caretaker is so focused on positioning the infant on the mattress without waking the infant that frequently the parent or infant-caretaker forgets to raise the gate after the infant is placed on the mattress. The result is that the infant is left in a crib with the gate down. If the infant is old enough to roll and raise himself/herself, the infant could fall out of the crib at a later time because the crib gate remains in an open condition.

Moreover, a recent study conducted by a Temple University researcher has recommended increasing the side heights of cribs to reduce the number of falls from cribs. If this recommendation is followed, the opening and closing of the crib gate by the parent/caregiver should occur more often since raising the height of the crib sides makes it more difficult to place or lift a toddler from the crib without opening the gate. As a result, this increases the chances that a parent/caregiver may walk away from a crib with the toddler inside and with the crib gate left open.

The following U.S. patents disclose some form of indication or warning in association with a baby crib or bed.

U.S. Pat. No. 2,734,104 (Gollhofer) discloses an alarm for alerting an attendant that the crib gate is in a down position.

U.S. Pat. No. 4,231,030 (Weiss) discloses a safety device for a crib that provides an indicating light or an alarm at the crib to alert a person to the fact that the crib gate is in a down position.

U.S. Pat. No. 4,951,032 (Langsam) discloses a crib rail safety monitor that utilizes a weight sensor for detecting the presence of a child in the crib and an ultrasonic motion detector or infrared temperature sensor for detecting the presence of an attendant at the crib in order to provide an indication or alarm at the crib that the crib gate is down when the child is in the crib and is unattended.

U.S. Pat. No. 5,057,819 (Valenti) discloses a safety cushion device that is positioned on the floor adjacent the baby crib for cushioning the fall of a child and an alarm for alerting an adult of such a fall.

U.S. Pat. No. 5,291,181 (DePonte) discloses a wet bed alarm and temperature monitoring system for detecting urine on the bed and the temperature of a person lying on the bed and for supplying a remote annunciator panel with such information.

U.S. Pat. No. 5,629,683 (Slomowitz et al.), whose entire disclosure is incorporated by reference herein, discloses an automatic crib gate indicator that utilizes a remote-enabling means to enable a crib gate sensor that detects the open condition of the crib gate and then transmits a signal to a remotely located indicator.

U.S. Pat. No. 5,757,274 (Slomowitz et al.), whose entire disclosure is incorporated by reference herein, discloses an automatic crib gate indicator that utilizes a crib gate sensor, for detecting the open condition of the crib gate, that is integrated with a baby monitoring system.

U.S. Pat. Nos. 6,225,913 (Slomowitz et al.) and U.S. Pat. No. 6,433,699 (Slomowitz et al.), whose entire disclosures are incorporated by reference herein, discloses an automatic crib gate indicator that utilizes a crib gate sensor for detecting the open condition of the crib gate and provides a remotely-located indication of that open condition.

However, there remains a need for a non-intrusive crib gate position indicator that provides the parent or infant-caretaker at the crib location, or remote from the crib Location, with an automatic indication or warning of the crib gate being left in an open condition, and which detects the open condition of the gate using non-contact sensing.

SUMMARY OF THE INVENTION

An apparatus for use with a baby crib having at least one gate that is movable (e.g., a vertically-displaceable gate, a rotatably-displaceable gate, etc.) with respect to a crib frame. The apparatus has a first portion (e.g., an emitter, emitter/detector, detector, passive target, etc.) mountable to the moveable gate and a second portion (e.g., an emitter, emitter/detector, detector, passive target, etc.) that is mountable to the crib frame. The apparatus detects the open condition of the movable gate without the first and second portions making contact with each other and with one of the portions providing an indication (e.g., a visual indication, an audible indication, etc.) of the open condition.

A method for detecting the open condition of a movable gate (e.g., a vertically-displaceable gate, a rotatably-displaceable gate, etc.) of a crib having a crib frame. The method comprises the steps of: coupling a first member (e.g., an emitter, emitter/detector, detector, passive target, etc.) to the moveable gate and a second member (e.g., an emitter, emitter/detector, detector, passive target, etc.) to the crib frame; permitting one of the members to detect the presence of the other one of the members without the members contacting each other; providing an alert (e.g., a visual indication, an audible indication, etc.) in one of the members that the gate is open whenever the presence of the other one of the members is no longer detected.

A method for detecting the open condition of a movable gate (e.g., a vertically-displaceable gate, a rotatably-displaceable gate, etc.) of a crib having a crib frame. The method comprises the steps of: coupling a first member (e.g., an emitter, emitter/detector, detector, passive target, etc.) to the moveable gate and a second member (e.g., an emitter, emitter/detector, detector, passive target, etc.) to the crib frame; permitting one of the members to detect the presence of the other one of the members without the members contacting each other; providing an alert (e.g., a visual indication, an audible indication, etc.) in one of the members that the gate is open whenever the presence of the other one of the members is either detected or momentarily detected.

An apparatus for use with a hospital bed having at least one gate that is movable (e.g., a vertically-displaceable gate, a rotatably-displaceable gate, etc.) with respect to a bed frame. The apparatus has a first portion (e.g., an emitter, emitter/detector, detector, passive target, etc.) mountable to the movable gate and a second portion (e.g., an emitter, emitter/detector, detector, passive target, etc.) mountable to the bed frame and wherein the apparatus detects the open condition of the moveable gate without the first and second portions making contact with each other and with one of the portions providing an indication (e.g., a visual indication, an audible indication, etc.) of the open condition.

An apparatus for use with a door or gate that is movable with respect to a door frame or gate frame, respectively. The apparatus has a first portion (e.g., an emitter, emitter/detector, detector, passive target, etc.) mountable to the door or gate and a second portion e.g., an emitter, emitter/detector, detector, passive target, etc.) mountable to the door frame or gate frame, respectively. The apparatus detects the open condition of the door or gate without the first and second portions making contact with each other and with one of the portions providing an indication (e.g., a visual indication, an audible indication, etc.) of the open condition.

An apparatus for use with a baby crib having at least one gate (e.g., a vertically-displaceable gate, a rotatably-displaceable gate, etc.) that is moveable with respect to a crib frame. The apparatus comprises: a first portion (e.g., an emitter, emitter/detector, detector, passive target, etc.) mountable to the movable gate; a second portion (e.g., an emitter, emitter/detector, detector, passive target, etc.) mountable to the crib frame, and wherein the first and second portions are configured to detect the open condition of the moveable gate without contacting each other; a transmitter for emitting a wireless signal indicative of the open condition of the moveable gate, and wherein the transmitter forms a part of the first or said second portion and is activated by the first or said second portion when the open condition is detected; and a remotely-located receiver that activates a crib gate open indicator (e.g., a visual indication, an audible indication, a tactile indicator, etc.) whenever the receiver receives the wireless signal.

An apparatus for use with a hospital bed having at least one gate that is movable (e.g., a vertically-displaceable gate, a rotatably-displaceable gate, etc.) with respect to a bed frame. The apparatus has a first portion (e.g., an emitter, emitter/detector, detector, passive target, etc.) mountable to the movable gate, a second portion (e.g., an emitter, emitter/detector, detector, passive target, etc.) mountable to the bed frame and an indicator located remote from the bed. The apparatus detects the open condition of the moveable gate without the first and second portions making contact with each other and providing the indicator (e.g., a visual indication, an audible indication, a tactile indicator, etc.) with an indication of the open condition.

An apparatus for use with a door or gate that is movable with respect to a door frame or gate frame, respectively. The apparatus has a first portion (e.g., an emitter, emitter/detector, detector, passive target, etc.) mountable to the door or gate, a second portion (e.g., an emitter, emitter/detector, detector, passive target, etc.) mountable to the door frame or gate frame, respectively, and an indicator (e.g., a visual indication, an audible indication, a tactile indicator, etc.) located remote from the door or gate. The apparatus detects the open condition of the door or gate without the first and second portions making contact with each other and with one of the portions providing the indicator with an indication of the open condition.

A baby monitoring system for use with a baby crib having at least one gate that is moveable (e.g., a vertically-displaceable gate, a rotatably-displaceable gate, etc.) with respect to a crib frame. The system comprises: a first portion (e.g., an emitter, emitter/detector, detector, passive target, etc.) mountable to the movable gate; a second portion (e.g., an emitter, emitter/detector, detector, passive target, etc.) mountable to the crib frame, and wherein the first and second portions are configured to detect the open condition of the moveable gate without contacting each other and wherein the first or second portion generates a first signal indicative of the open condition of the moveable gate; a microphone for converting sounds in the vicinity of the crib into a second signal and wherein the microphone forms a part of the first or second portion that generates the first signal; a transmitter, coupled to the microphone, for wirelessly transmitting the second signal, and wherein the transmitter also wirelessly transmitting the first signal when generated by the first or second portion; and a remotely-located receiver that converts the second signal into sounds and provides a crib gate open indication (e.g., a visual indication, an audible indication, a tactile indicator, etc.) when the first signal is also received.

DESCRIPTION OF THE DRAWINGS

Many of the attendant advantages of this invention will be readily appreciated as the same becomes better understood by reference to the following detailed description when considered in connection with the accompanying drawings wherein:

FIG. 4A is an exemplary circuit schematic of the emitter of the preferred embodiment of the present invention;

FIG. 9 is a partial side view of the crib of FIG. 1 showing a third embodiment mounted to the moveable gate and crib, with the moveable gate being shown in a closed position and the indicator being de-activated;

FIG. 10 is a partial side view of the crib of FIG. 1 showing the third embodiment mounted to the moveable gate and crib, with the moveable gate being shown in an open condition causing the indicator to activate;

DESCRIPTION OF THE PREFERRED EMBODIMENT OF THE INVENTION

Figure 1:
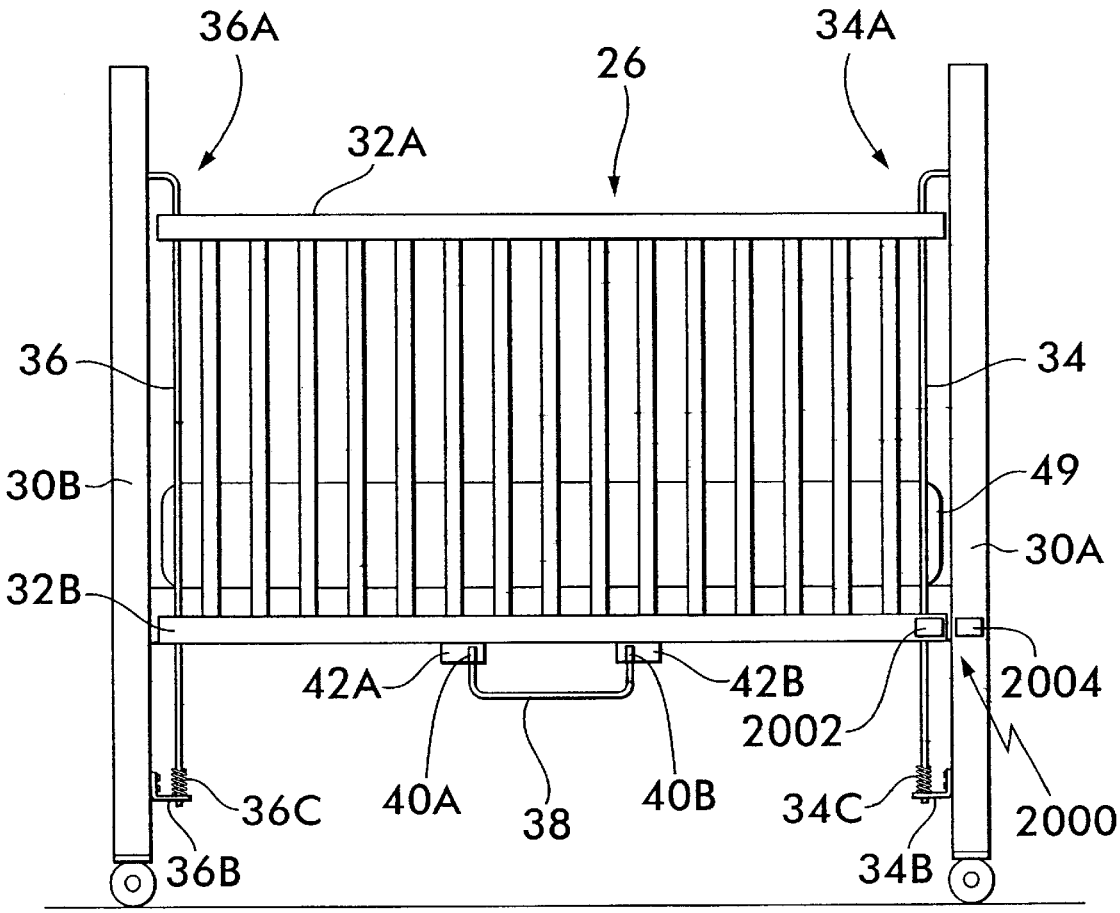
FIG. 1 is a side view of a conventional crib having the present invention coupled thereto.

Referring now in greater detail to the various figures of the drawing wherein like reference characters refer to like parts, there is shown generally at 2000 in FIG. 1, a crib gate position indicator, hereinafter "CGPI 2000." The CGPI 2000 comprises a first portion 2002 mountable to the moveable gate 26 and a second portion 2004 mountable to the frame of the crib 22. In general, these two portions interact with each other in a non-contact manner, with one of the two portions including an alert, e.g., a visual indicator, an audible indicator, etc., to alert a nearby caretaker that the crib gate 26 is in an open condition. Before a discussion of the present invention 2000 is made, a summary of a conventional crib is given.

By way of example only, FIG. 1 depicts a conventional crib 22 having a vertically-displaceable gate showing the present invention 2000 coupled thereto. With particular regard to the conventional crib 22 of FIG. 1, the moveable crib gate 26 comprises an upper molding 32A and a lower molding 32B. The moldings have respective holes (not shown) that align to allow the crib gate 26 to be vertically displaceable along a first slide rod 34 and a second slide rod 36. The slide rods 34 and 36 are fixedly secured to crib legs 30A and 30B at their respective top ends 34A and 36A. In addition, the slide rods 34 and 36 are fixedly secured to crib legs 30A and 30B at their respective bottom ends by respective support plates 34B and 36B. To cushion the weight of the gate 26 when the gate is down, the lower molding 32B rests on a pair of support springs 34C and 36C. The crib gate 26 is designed to be in either one of two states: an open (gate-down) condition or a closed (gate-up) condition. FIG. 1 shows the crib gate 26 in a closed (gate-up) condition. Coupled to the underside of the mattress support is a pivoting footbar 38. The footbar 38 is pivotally coupled to the mattress support and is spring-loaded such that whenever there is no countering force by the parent's or infant caretaker's foot, two prongs 40A and 40B, located on the footbar 38, are positioned in the plane of vertical displacement of the gate 26. These prongs 40A and 40B engage two corresponding catch plates 42A and 42B positioned on the bottom surface of the lower molding 32B.

Hence, when these prongs 40A and 40B engage the corresponding catches 42A and 42B, the crib gate 26 is in the closed (gate-up) position. To open the gate, the parent or infant-caretaker pivots the footbar 38 by pushing the footbar 38 towards the center of the crib 22 (into the plane of FIG. 1), thereby disengaging the prongs 40A and 40B from the corresponding catches 42A and 42B. Such disengagement allows the crib gate 26 to drop down. In this position, the bottom surface of the Lower molding 32B rests on cushioning springs 34C and 36C. To close the gate, the parent or infant-caretaker simply pulls the upper molding 32A upward until the corresponding catches 42A and 42B re-engage the prongs 40A and 40B on the footbar 38, thereby locking the crib gate 26 in a closed (gate-up) condition.

Figure 2:
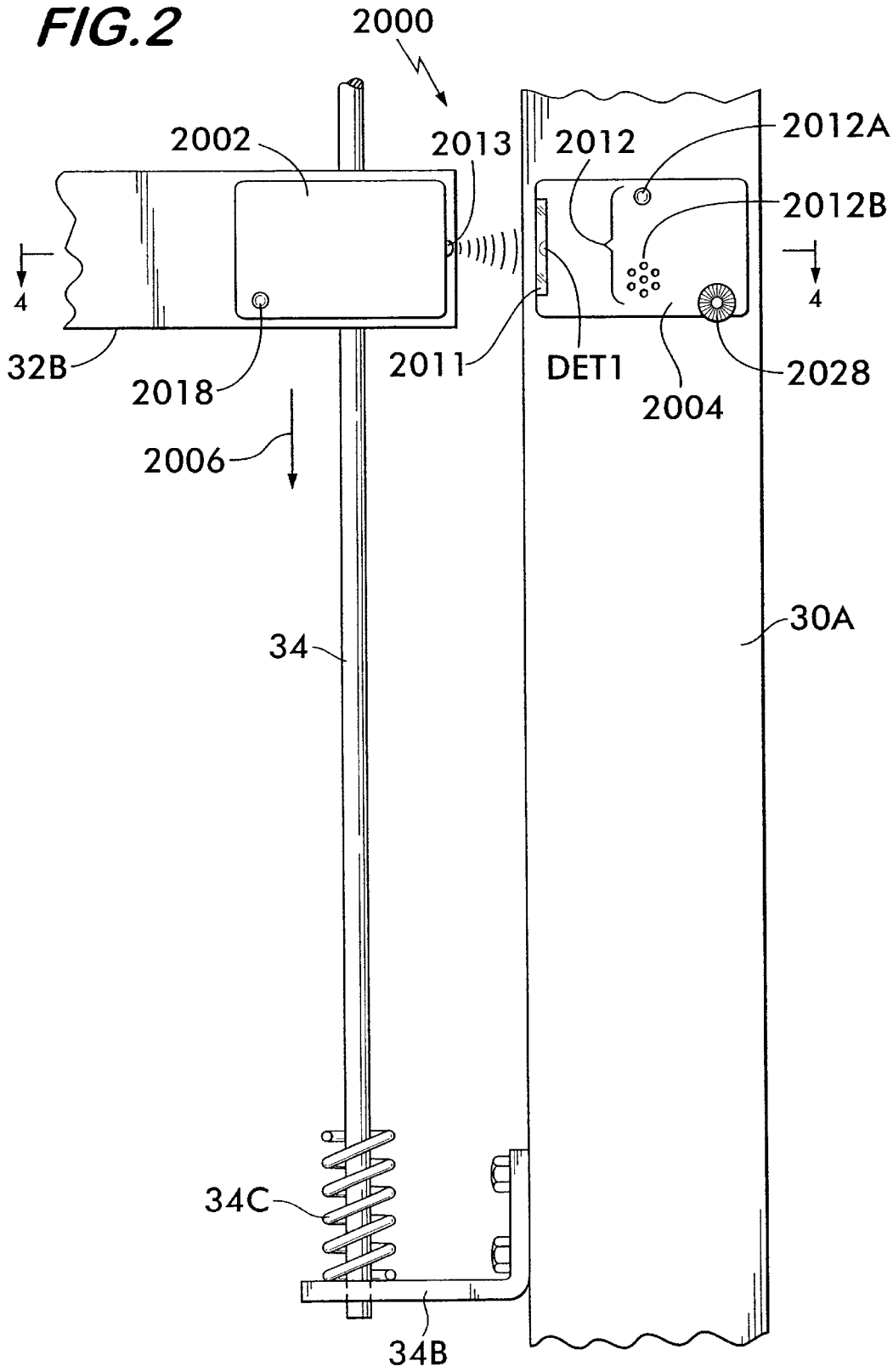
FIG. 2 is a partial side view of the crib showing the present invention mounted to the moveable gate and crib, with the moveable gate being shown in a closed position and the indicator being de-activated.
Figure 3:
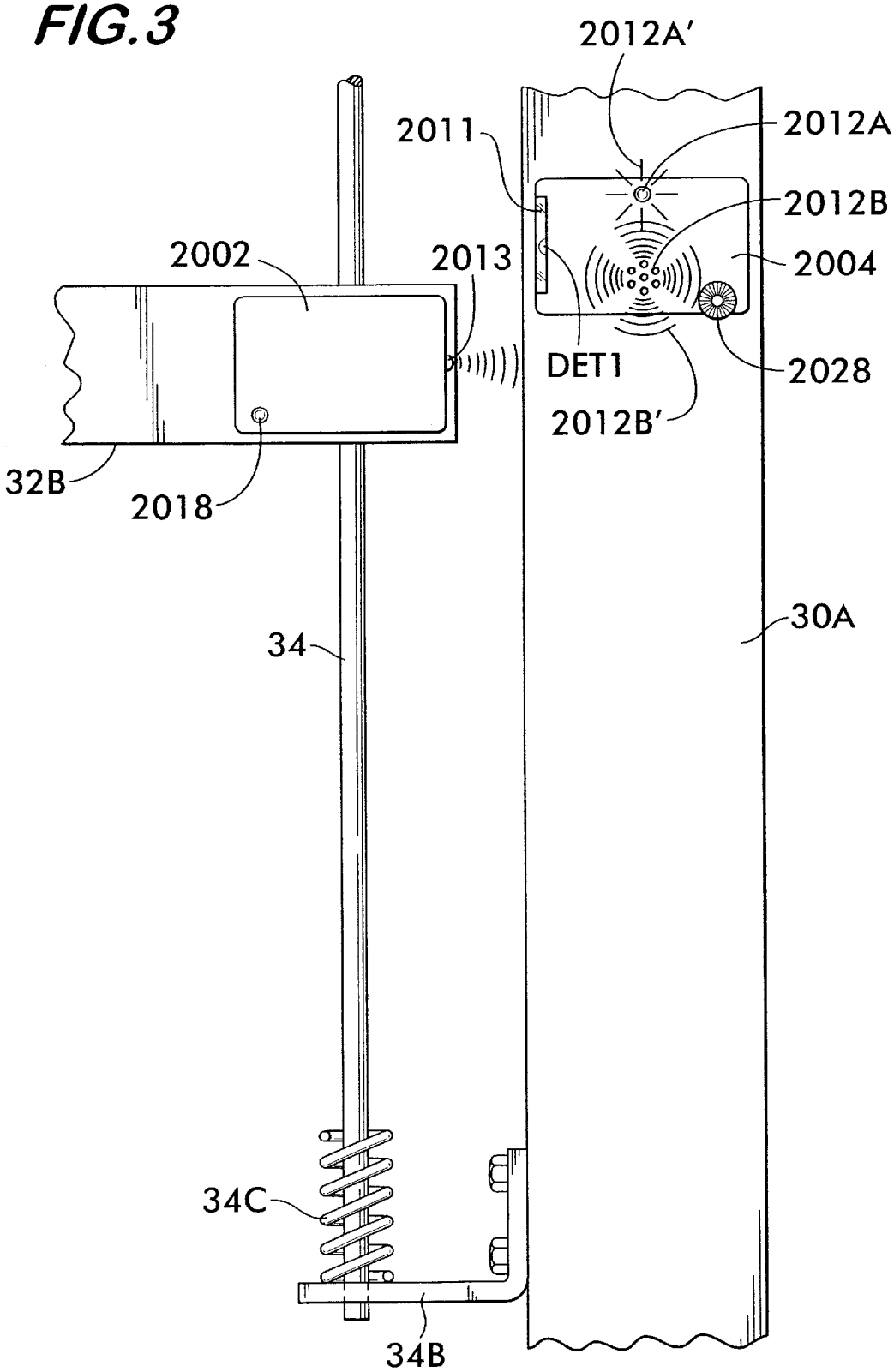
FIG. 3 is a partial side view of the crib showing the present invention mounted to the moveable gate and crib, with the moveable gate being shown in an open position, causing the indicator to activate.
Figure 4:
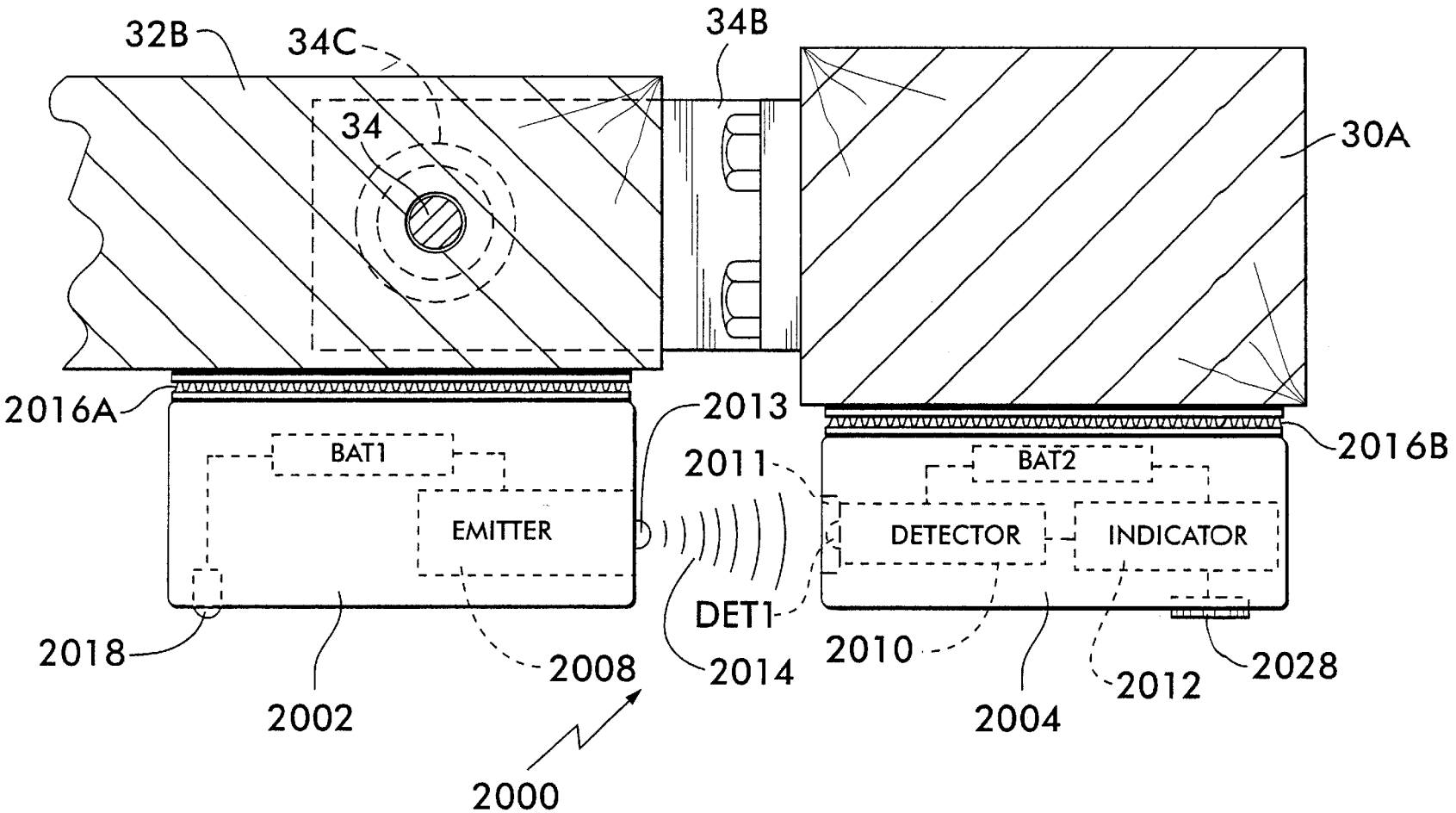
FIG. 4 is an enlarged view of the present invention taken approximately along line 4—4 of FIG. 2 showing an emitter in a first portion of the preferred embodiment of the present invention coupled to the moveable gate and a detector and indicator in a second portion of the preferred embodiment of the present invention coupled to the frame of the crib with the moveable gate being closed.

As mentioned earlier, the present invention 2000 comprises a first portion 2002 and a second portion 2004 that are used with the crib 22. The preferred embodiment, which is shown in FIGS. 2–4, comprises the first portion 2002 that is coupled to the moveable gate 26 (e.g., one end of the lower molding 32A of the gate 26) and the second portion 2004 that is coupled to the frame of the crib 22, e.g., a crib leg 30A. When the gate 26 is closed (FIG. 2), these two portions 2002 and 2004 are in the same vicinity whereas when the gate 26 is opened (moved in the direction of arrow 2006), as shown in FIG. 3, these two portions 2002 and 2004 are no longer in the same vicinity. It should be understood that the respective locations of the first 2002 and second portions 2004 are by way of example only and that any location where these two portions 2002/2004 can interact (as will be discussed later) with each other in substantially close proximity is within the broadest scope of this invention.

In particular, as shown in FIG. 4, the first portion 2002 comprises an emitter 2008 and the second portion 2004 comprises a detector 2010 and an indicator 2012. During operation, the emitter 2008 emits a signal 2014 which, or a portion of which, is detected by the detector 2010 whenever the displaceable gate 26 is in a closed condition (FIG. 2). As long as the detector 2010 detects the signal 2014, or a portion thereof, the detector 2010 keeps the indicator 2012 de-activated. However, when the gate 26 is opened, the emitter 2008 and detector 2010 become mis-aligned, and the detector 2010 is configured to activate the indicator 2012 (e.g., a visual indicator 2012A and/or an audible indicator 2012B), as shown by the visual signal 2012A' and/or the audible signal 2012B' in FIG. 3; the visual indicator 2012A may comprise any type of illuminator, such as but not limited to LEDs, light bulbs, displays, etc. Similarly, the audible indicator 2012B may comprise any type of annunciator, (e.g., speaker, 32 Ohm, 0.79", 2W, or buzzer, such as the Panasonic EFB-CBC37C11 ceramic buzzer, speaker, etc.,). Once the crib gate 26 is placed into the closed position again (FIG. 2), the signal 2014, or a portion thereof, is again detected by the detector 2010 and the indicator 2012 is immediately de-activated.

Both the first portion 2002 and the second portion 2004 can be adjustably coupled to the moveable gate 26 and the frame of the crib 22, respectively, using a variety of means. The preferred means is a hook-hook means, (e.g., Archer Super Lock™ Fastener #64-2360) as indicated by 2016A and 2016B, shown in FIG. 4. A less preferred means is a hook and pile means, such as that sold under the mark VELCRO®; alternatively, the first portion 2002 and the second portion 2004 can be coupled to the gate 26 and frame of the crib 22, respectively, using fastening means, e.g., screws, bolts, clamps, etc.

Figure 4B:
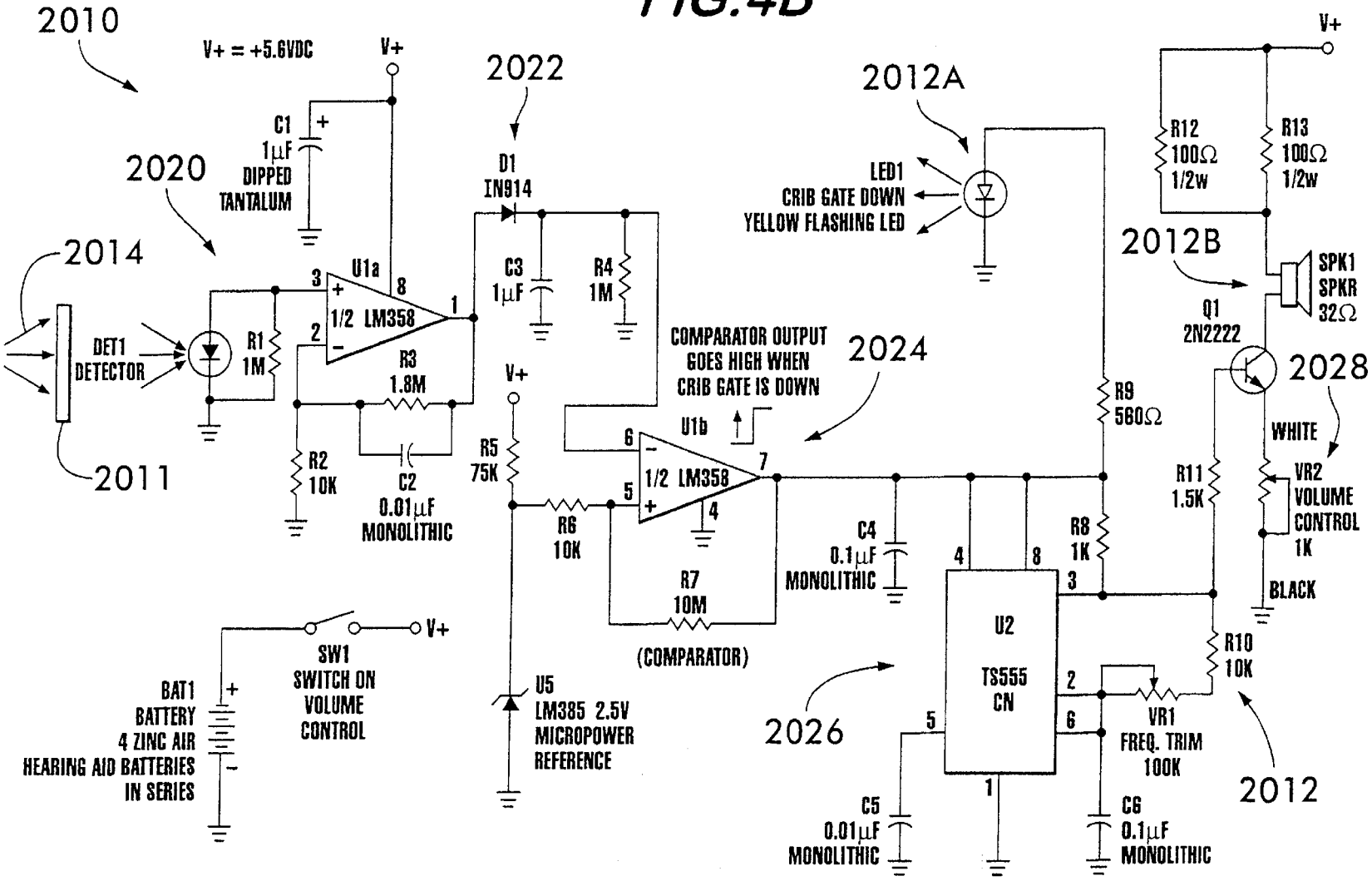
FIG. 4B is an exemplary circuit schematic of the detector of the preferred embodiment of the present invention.

FIG. 4A depicts an exemplary implementation of the emitter 2008 and FIG. 4B depicts an exemplary implementation of the detector 2010. In particular, the emitter 2008 (FIG. 4A) includes an emitter element 2013 (e.g., RS 276-142, 915 nm, infrared) that is energized by an oscillator 2015 (e.g., IC TS555C CMOS timer) whose output is duty-cycled by a diode circuit 2017 to reduce the power draw for the emitter 2008. The emitter 2008 also includes a low battery indicator 2018 and accompanying circuitry. See Table 1 for exemplary components used in the emitter 2008.

As shown in FIG. 4B, the detector 2010 basically comprises an amplifier stage 2020 followed by an integrator 2022 which outputs a DC level to a comparator 2024. As long as the detector 2010 is detecting the signal 2014, or a portion thereof, the comparator 2024 output remains hardover in a Low state, due to the DC level from the integrator 2022 storing the signal 2014, or a portion thereof, on the capacitor C3. However, when the detector 2010 no longer detects the signal 2014, or a portion thereof, the comparator 2024 output flips high, thereby activating an astable oscillator 2026 (e.g., IC TS555C CMOS timer) whose output drives the indicator 2012 (e.g., either or both the visual indicator 2012A and/or the audible indicator 2012B). In addition, a volume control switch 2028 may be included with the detector 2010 to control the sound Level of the audible signal 2012A'; although FIG. 4B also shows the switch 2028 as having an on/off capability (SW1), this is also not required. See Table 2 for exemplary components used in the detector 2010. To minimize the effects of bright sunlight or room light being detected by the detector 2010, an IR lens filter 2011 (e.g., ACRYLITE® GP infrared transmitting (IRT) sheet by CYRO Industries of Orange, Conn.) is positioned in front of the detector element DET1 (FIGS. 4 and 4B).

It should be understood that the circuitries and battery configuration shown in FIGS. 4A–4B are by way of example only and that other configurations and the use of integrated circuits rather than discrete components are fully within the scope of the present invention and that the emitter 2008 and the detector 2010 are not, in any way, limited to the circuitries and batteries shown in FIGS. 4A–4B.

It should also be understood that the present invention 2000 does not require that the first portion 2002 be positioned at the final resting position of the crib gate 26 (i.e., on top of the support spring 34C) in order to activate the indicator 2012; rather, any slight mis-alignment of the first portion 2002 with respect to the second portion 2004 does not permit any signal 2014 to be detected by the detector 2010 and the result is the immediate activation of the indicator 2012.

It should also be understood that the coupling of the first portion 2002 to the moveable gate 26 and the second portion 2004 to the frame of the crib 22 is by way of example only and that these portions could be interchanged, i.e., the second portion 2004 could be coupled to the moveable gate 26 and the first portion 2002 could be coupled to the frame of the crib 22. It is thus within the broadest scope of this invention to include all variations of the locations for these portions 2002/2004, and are not limited, in any way, to the locations shown.

Figure 5:
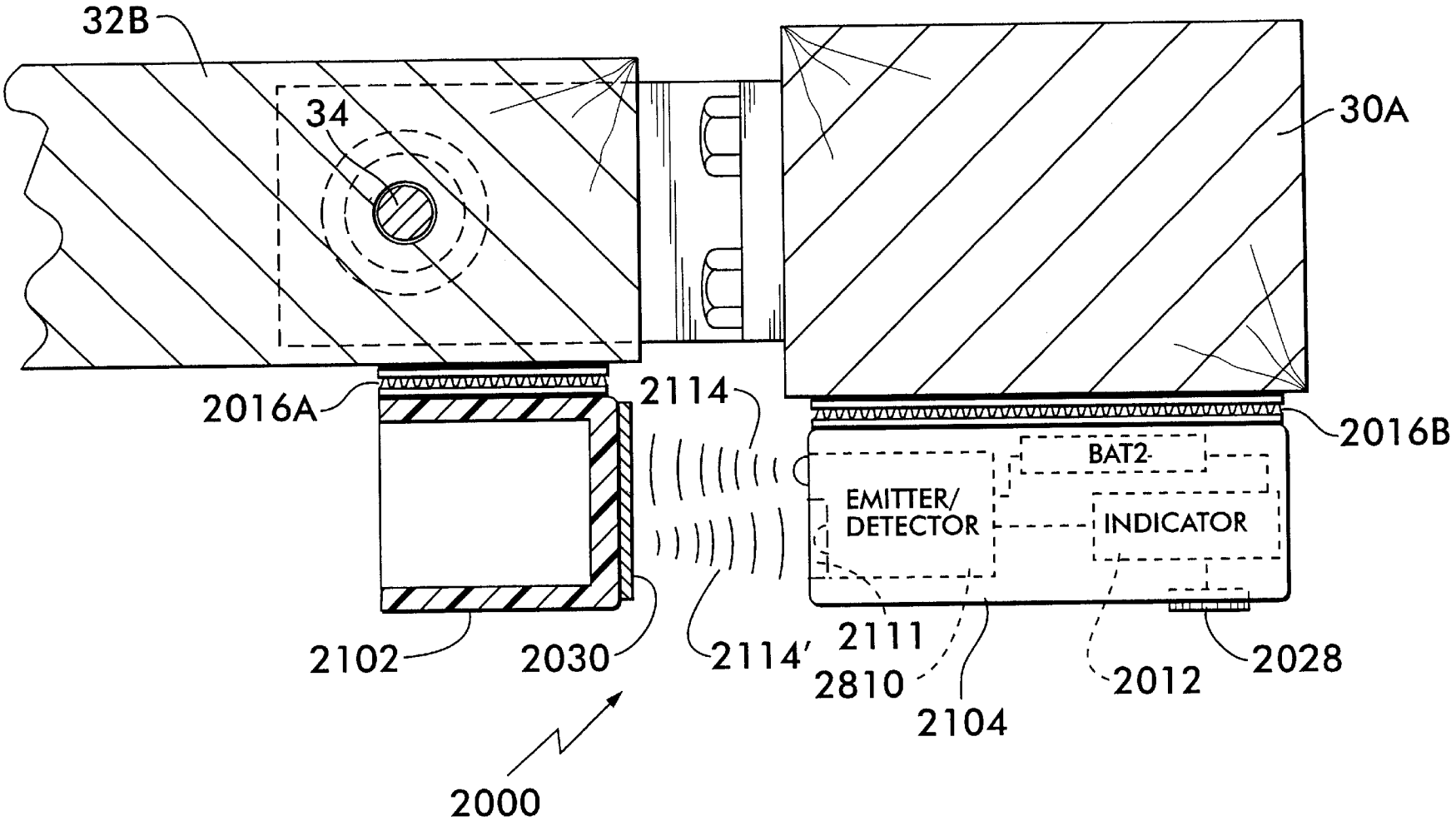
FIG. 5 is a view similar to FIG. 4 but showing a second embodiment of the present invention where the emitter and detector are combined into a single housing mounted to the crib and a passive target is mounted to the moveable gate and with the moveable gate being closed.
Figure 5A:
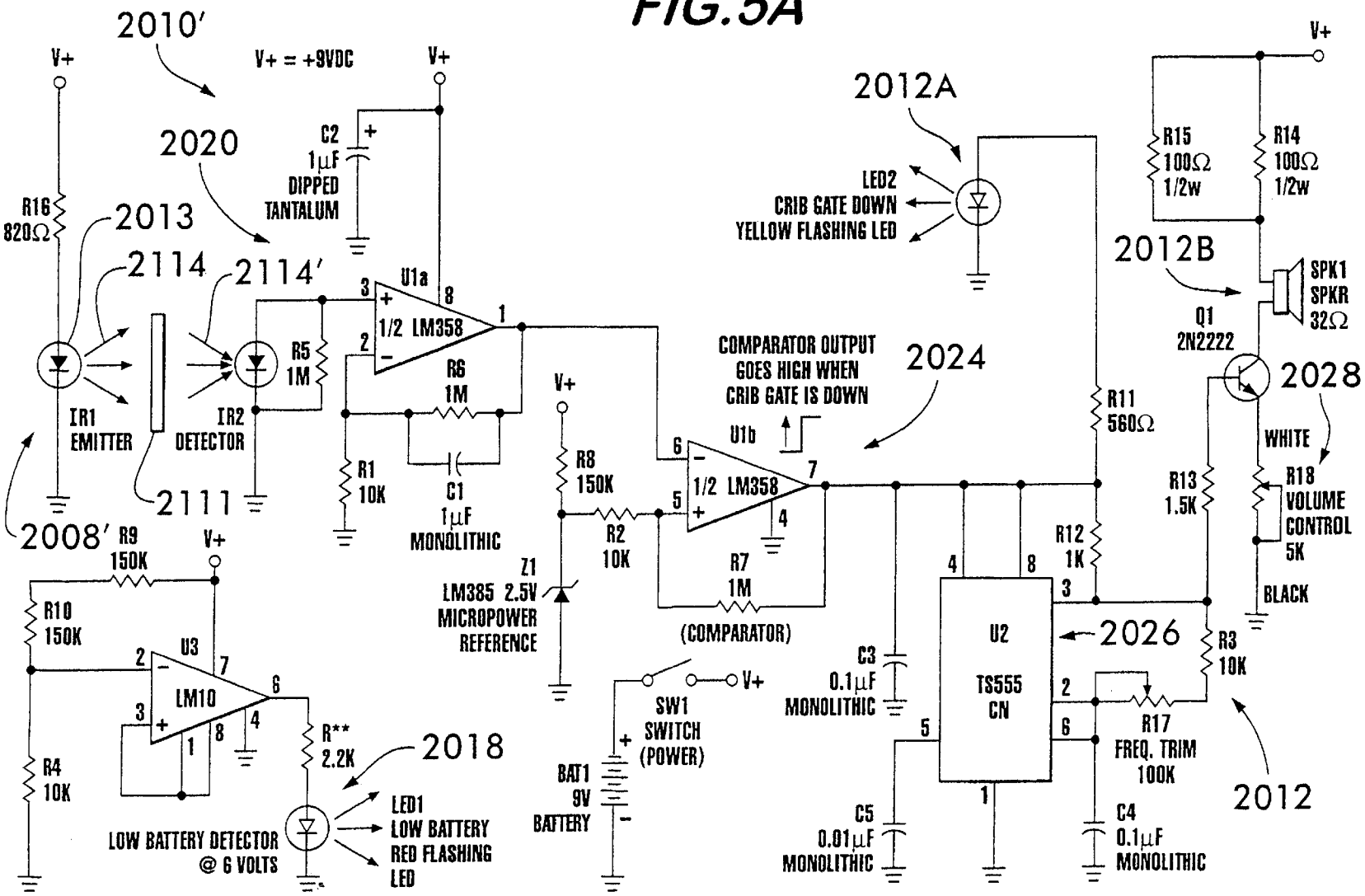
FIG. 5A is an exemplary circuit schematic of the combined emitter/detector of the second embodiment of the present invention.

A second embodiment of the present invention 2000 is shown in FIGS. 5–5A. In particular, the second embodiment also comprises a first portion 2102 and a second portion 2104. The first portion 2102 comprises a passive target 2030 (e.g., reflective tape, such as Mylar® reflective silver tape, metallic surface, or any type of infrared or light reflective surface). The second portion 2014 comprises an emitter 2008' (FIG. 5A), a detector 2010' (FIG. 5A) and the indicator 2012. As with the preferred embodiment, the first portion 2102 and the second portion 2104 are adjustably coupled to the moveable gate 26 and the frame of the crib 22, respectively, using a variety of means. The preferred means is a hook-hook means, (e.g., Archer Super Lock™ Fastener #64-2360) as indicated by 2016A and 2016B, shown in FIG. 5. A less preferred means is a hook and pile means, such as that sold under the mark VELCRO®; alternatively, the first portion 2102 and the second portion 2104 can be coupled to the gate 26 and frame of the crib 22, respectively, using fastening means, e.g., screws, bolts, clamps, etc.

In this second embodiment, with the crib gate 26 in a closed condition and with both portions 2102/2104 installed, the emitter 2008' emits a first signal 2114 that interacts with the reflective surface 2030 of the second portion 2104, whereby a second signal 2114' (which is the signal 2114, or some portion thereof) is then detected by the detector 2010'. When this signal 2114' is detected, the detector 2010' does not activate the indicator 2012. As long as the detector 2010' detects the second signal 2114', the detector 2010' keeps the indicator 2012 de-activated. However, when the gate 26 is opened, the reflective surface 2030 and the detector 2010' become mis-aligned (not shown but similar to the positions shown in FIG. 3 with regard to the preferred embodiment), and the detector 2010' is configured to activate the indicator 2012 (e.g., the visual indicator 2012A and/or an audible indicator 2012B), similar to those depicted as the visual signal 2012A' and/or the audible signal 2012B' in FIG. 3. Once the crib gate 26 is placed into the closed position again (FIG. 2), the second signal 2114' is again detected by the detector 2010' and the indicator 2012 is immediately de-activated.

As with the preferred embodiment, it should also be understood that the present invention 2000 does not require that the first portion 2102 be positioned at the final resting position of the crib gate 26 (i.e., on top of the support spring 34C) in order to activate the indicator 2012; rather, any slight misalignment of the first portion 2102 with respect to the second portion 2104 does not permit any signal 2114' to be detected by the detector 2010' and the result is the immediate activation of the indicator 2012.

FIG. 5A depicts an exemplary implementation of the combined emitter 2008' and the detector 2010' (together referred to as "emitter/detector 2810"). In particular, the emitter 2008' includes the emitter element 2013 (e.g., RS 276-142, 915 nm, infrared) that is energized from the battery BAT1. Alternatively, although not shown, the emitter element 2013 in the emitter 2008' may be energized in the same manner as the emitter 2008 in the preferred embodiment, namely, by the oscillator 2015 (e.g., IC TS555C CMOS timer) whose output is duty-cycled by a diode circuit 2017 (see FIG. 4B) to also reduce the power draw for the emitter 2008'.

The detector 2010' (also FIG. 5A) basically comprises the amplifier stage 2020 followed by the comparator 2024. As long as the detector 2010' is detecting the second signal 2114', the comparator 2024 output remains hardover in a low state. However, when the detector 2010 no longer detects the second signal 2114', the comparator 2024 output flips high, thereby activating the astable oscillator 2026 (e.g., IC TS555C CMOS timer) whose output drives the indicator 2012 (e.g., either or both the visual indicator 2012A and/or the audible indicator 2012B). Alternatively, although not shown, where the emitter 2008' is energized using the duty cycle discussed with regard to the preferred embodiment emitter 2008, the detector 2010' circuitry would also include the integrator stage 2022 between the amplifier stage 2020 and the comparator 2024. In addition, the volume control switch 2028 may be included with the detector 2010' to control the sound level of the audible signal 2012A'; although FIG. 5A also shows the switch 2028 as having an on/off capability (SW1), this is also not required. The combined emitter/detector 2810 also includes the low battery indicator 2018 and accompanying circuitry. See Table 3 for exemplary components used in the combined emitter/detector 2810. As mentioned with respect to the preferred embodiment, to minimize the effects of bright sunlight or room light being detected by the detector 2010', an IR lens filter 2111 (e.g., ACRYLITE® GP infrared transmitting (IRT) sheet by CYRO Industries of Orange, Conn.) is positioned in front of the detector element DET1 (FIGS. 5 and 5A).

It should be understood that the combined emitter/detector 2810 circuitries and battery configuration shown in FIG. 5A are by way of example only and that other configurations and the use of integrated circuits rather than discrete components are fully within the scope of the present invention and that the combined emitter/detector 2810 is not, in any way, limited to the circuitries and batteries shown in FIG. 5A.

As with the preferred embodiment, it should also be understood that the coupling of the first portion 2102 to the moveable gate 26 and the second portion 2104 to the frame of the crib 22 is by way of example only and that these portions could be interchanged, i.e., the second portion 2104 could be coupled to the moveable gate 26 and the first portion 2102 could be coupled to the frame of the crib 22. It is thus within the broadest scope of this invention to include all variations of the locations for these portions 2102/2104, and are not limited, in any way, to the locations shown.

Figure 6:
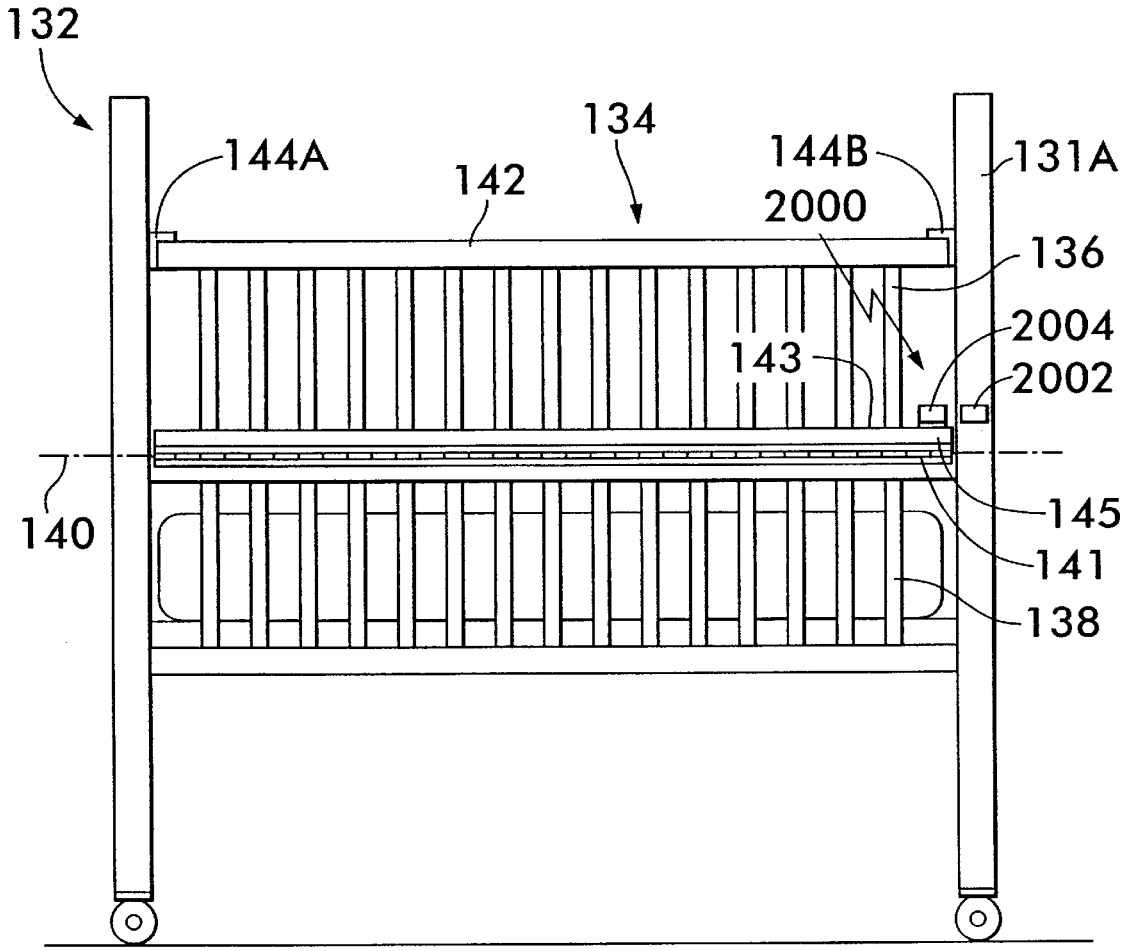
FIG. 6 is a side view of another conventional crib having a rotating gate with the present invention coupled thereto.

It should also be noted that it is also within the broadest aspect of this invention to have the CGPI 2000 be compatible with a variety of displaceable gate cribs, such as a Gerry Wood Products, Inc. Model 85 crib. For example, there is shown in FIG. 6, a crib 132 having a crib gate 134 that has a rotatable upper portion 136 and fixed lower portion 138. In particular, the upper portion 136 rotates about an axis 140 away from the crib interior (out of the plane of the paper in FIG. 6), thereby opening the gate 134. A hinge 141 rotatably couples the upper portion 136 to the fixed lower portion 138. The ends of the upper molding 142 are releasably press-fit into catches 144A and 144B by the parent or infant-caretaker to close the gate 136. Pressure on the upper molding 142 away from the crib interior disengages the ends of the upper molding 142 from the catches 144A and 144B, thereby opening the gate 136. FIG. 6 depicts the crib gate 134 in a closed condition.

Figure 7:
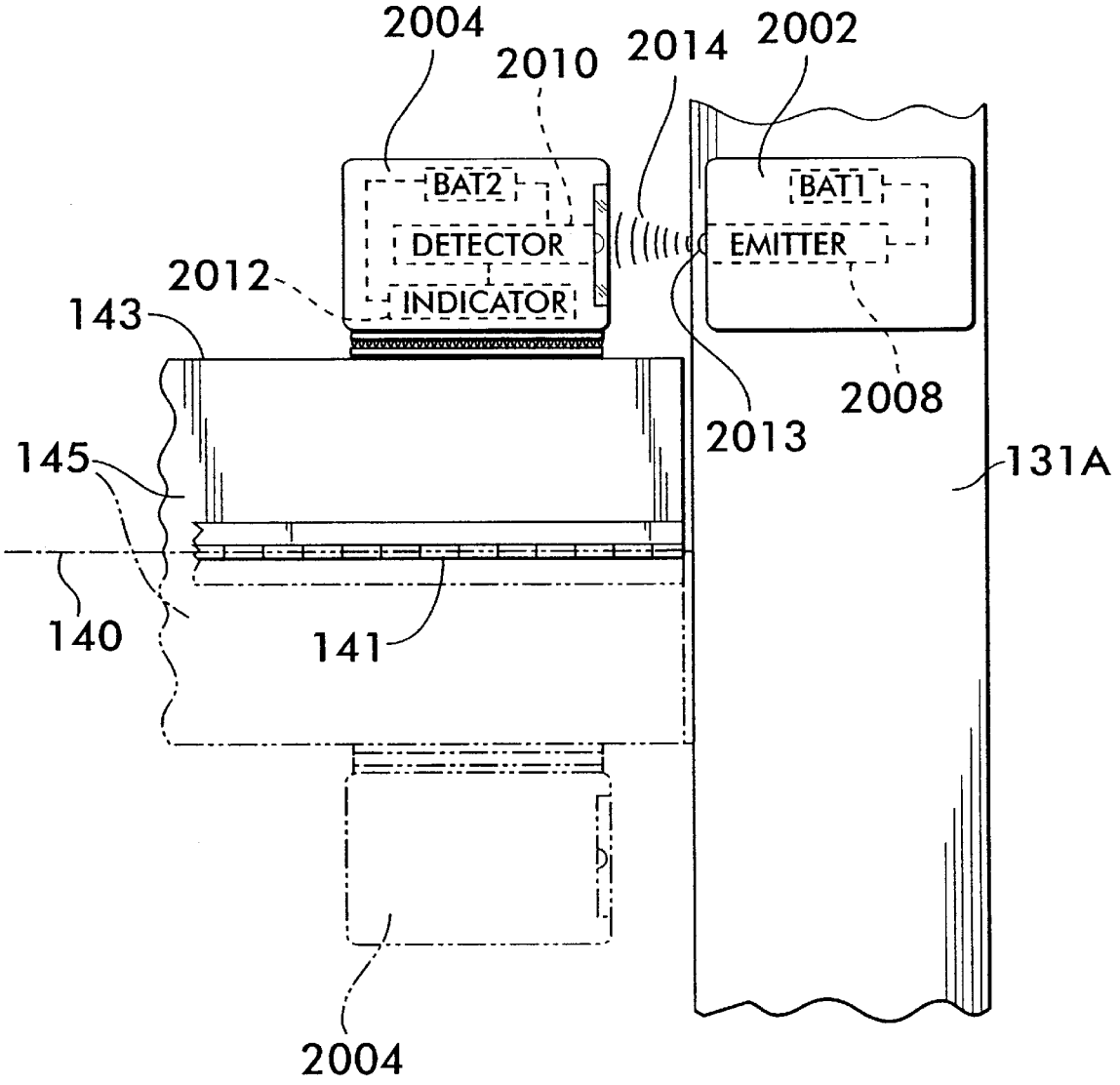
FIG. 7 is an enlarged view of a portion of the rotatable gate and crib leg of the crib of FIG. 6 showing the preferred embodiment coupled thereto.

The first and second portions of the present invention 2000 can be coupled to the crib 132 in the following exemplary configurations using the adjustable coupling means described earlier. For example, as shown in FIG. 7, using the preferred embodiment, the first portion 2002 can be releasably coupled to the frame of the crib 132, e.g., to upper portion of the crib leg 131A, while the second portion 2004 can be releasably coupled to the rotatable gate 136, e.g., to the molding 145 (e.g., on its upper surface 143) using the hook-hook means, or the hook-pile means, or any of the other means discussed earlier. With the rotatable gate 136 closed, as shown in FIG. 7, the detector 2010 detects the signal 2014 and maintains the indicator 2012 in a de-activated state. However, as soon as the rotatable gate 136 is opened, i.e., the second portion 2004 is slightly mis-aligned with the first portion 2002 (i.e., the gate 136 is moved slightly out of the plane of the paper), the detector 2010 no longer detects the signal 2014 and the detector 2010 activates the indicator 2012; when the rotatable gate 136 is fully opened, the final resting position of the rotatable gate 136 and the second portion 2004 is shown in phantom in FIG. 7. It should be understood that it is within the broadest scope of the invention to permit the first and second portions 2002 and 2004 to be interchanged, i.e., the first portion 2002 could be releasably coupled to the rotatable gate 136 and the second portion 2004 could be releasably coupled to the crib leg 131A without deviating from the scope of the invention. Thus, it is within the broadest scope of this invention to include all variations of the gate/crib frame locations for these two portions 2002/2004 which are not limited, in any way, to the locations shown in FIG. 7.

Figure 8:
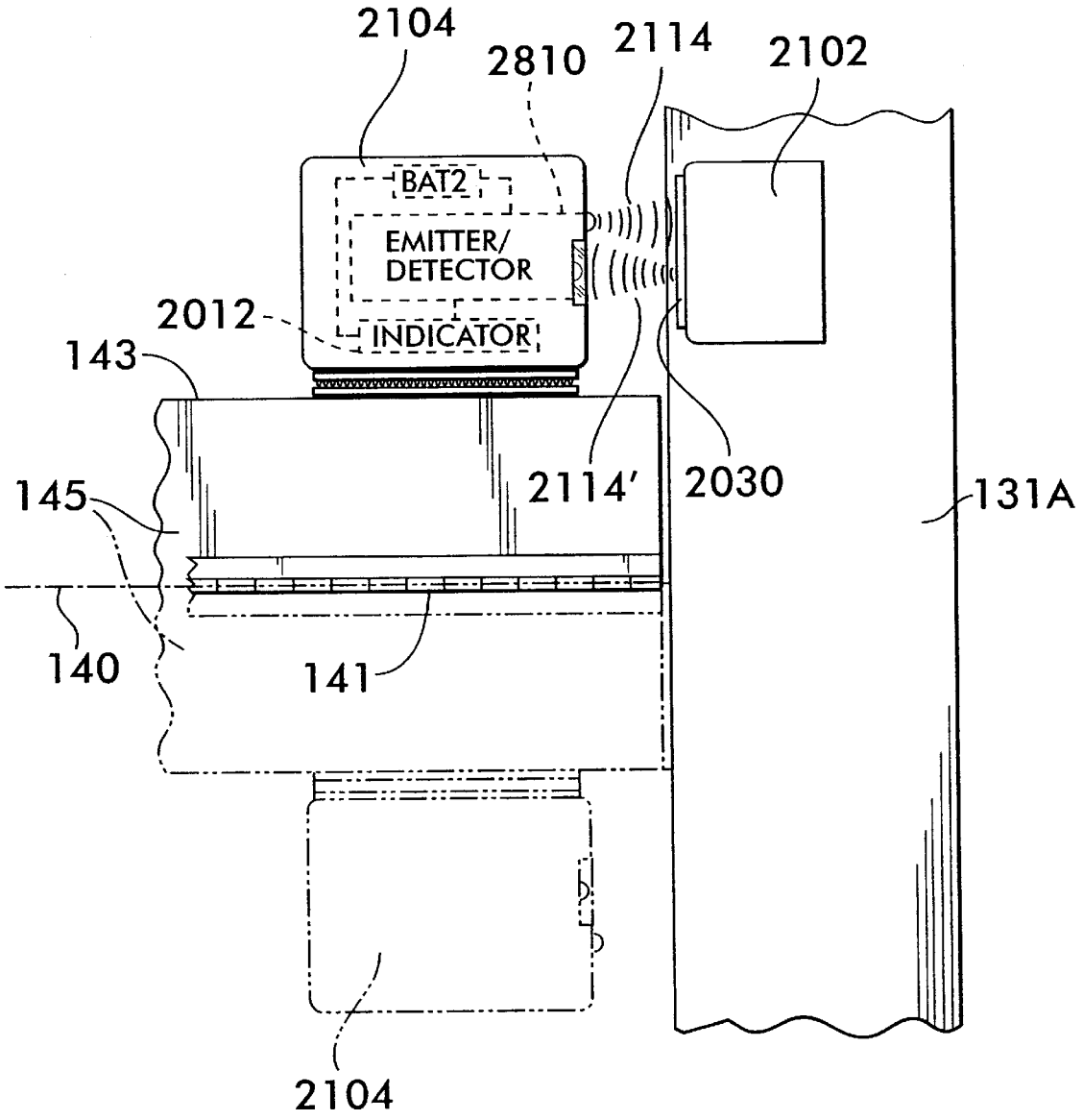
FIG. 8 is enlarged view of a portion of the rotatable gate and crib leg of the crib of FIG. 6 showing the second embodiment coupled thereto.

Again, by way of example only, FIG. 8 shows the second embodiment (using the combined emitter/detector 2810) of the present invention releasably coupled to the crib 132. The first portion 2102 can be releasably coupled to the frame of the crib 132, e.g., to upper portion of the crib leg 131A, while the second portion 2104 can be releasably coupled to the rotatable gate 136, e.g., to the molding 145 (e.g., on its upper surface 143) using the hook-hook means, or the hook-pile means, or any of the other means discussed earlier. With the rotatable gate 136 closed, as shown in FIG. 8, the detector 2010' detects the signal 2114' and maintains the indicator 2012 in a de-activated state. However, as soon as the rotatable gate 136 is opened, i.e., the second portion 2104 is slightly mis-aligned with the first portion 2102 (i.e., the gate 136 is moved slightly out of the plane of the paper), the detector 2010' no longer detects the signal 2114' and the detector 2010' activates the indicator 2012; when the rotatable gate 136 is fully opened, the final resting position of the rotatable gate 136 and the second portion 2104 is shown in phantom in FIG. 8. It should be understood that it is within the broadest scope of the invention to permit the first and second portions 2102 and 2104 to be interchanged, i.e., the first portion 2102 could be releasably coupled to the rotatable gate 136 and the second portion 2104 could be releasably coupled to the crib leg 131A without deviating from the scope of the invention. Thus, it is within the broadest scope of this invention to include all variations of the gate/crib frame locations for these two portions 2002/2004 which are not limited, in any way, to the locations shown in FIG. 7.

It should be understood that it is within the broadest scope of the invention to include the use of alignment of the emitter 2008/detector 2010 (or the alignment of the combined emitter/detector 2810 and the passive target 2030) to activate the indicator 2012. For example, the detector 2010 can be configured to activate the indicator 2012 when it detects the signal 2014, or a portion of that signal 2014. To operate properly, the first portion 2002 and the second portion 2004 would be coupled to the crib 22 frame/moveable gate 26 (or 132) such that in the closed condition these two portions are misaligned such that the detector 2010 does not detect the signal 2014, or a portion thereof. Once the moveable gate 26 is in its fully open condition (e.g., the gate 26 is not being held partially-open by someone), the emitter 2008 and detector 2010 would be aligned, thereby causing the detector 2010 to activate the indicator 2012. This embodiment is less preferred because it only alerts someone whenever the moveable gate 26 is in its fully opened position. Another embodiment, included within the broadest scope of the invention, is to also configure the detector 2010 to activate the indicator 2012 when it detects the signal 2014, or a portion thereof, but only when the emitter 2008 passes the detector 2010 during movement of the moveable gate 26 (or 132). A latch circuit would be included in the detector 2010 to "capture" the "momentary" detection and which would maintain the activation of the indicator 2012 until the next "momentary" detection, indicative of the moveable gate 26 (or 136) being moved back into a closed position. A similar explanation applies to the combined emitter/detector 2810 and the passive target 2030. All of these less preferred embodiments are within the broadest scope of the present invention.

It should also be understood that the emitter 2008 and the detector 2010, and the combined emitter/detector 2810 and the passive target 2030, are by way of example only and that any similar or equivalent means, or other non-contact interaction means, for detecting the presence of either one of the portions 2002/2004 (or 2102/2104) is within the scope of this invention. For example, as shown in FIGS. 9–10, the combined emitter/detector 2810 may comprise an electric or magnetic field generator with the passive target 2030 comprising a dielectric or conductor (e.g., conductive or magnetic material) that acts to "disturb the electric or magnetic field" when it is in close proximity with the combined emitter/detector 2810. Thus, whenever the moveable gate 26 is in a closed condition (FIG. 9), the field disturber 2030 disturbs the electric or magnetic field established by the combined emitter/detector 2810 and when the gate 26 is moved into an open condition (FIG. 10), the detector 2010' detects the change of the disturbed field to a "non-disturbed" field and thereby activates the indicator 2012, as discussed previously. Alternatively, the first and second portions could be interchanged. In addition, a field disturber configuration of the present invention 2000 also includes a first portion and a second portion that emit respective fields that can disturb the other portion's field and wherein one of the portions includes a detector to detect its field's distortion by the other portion's field (or not detect any distortion, depending on the relative positions of these portions). Thus, it is within the broadest scope of the present invention to include other non-contact detection between the first portion 2002 (or 2102) and the second portion 2004 (or 2104), such as a proximity switch, a magnetically-coupled sensor, Hall effect sensor, etc., such as those shown in U.S. Pat. No. 4,278,968 (Arnett et al.); U.S. Pat. No. 5,365,214 (Angott et al.); U.S. Pat. No. 5,499,014 (Greenwaldt); and U.S. Pat. No. 5,689,236 (Kister), or capacitive sensors or RF field sensors such as that shown in U.S. Pat. No. 4,826,262 (Hartman et al.), or ultrasonic sensors such as those shown in U.S. Pat. No. 5,852,411 (Jacobs et al.) or U.S. Pat. No. 6,229,455 (Yost et al.) and all of whose entire disclosures are incorporated by reference herein. Thus, the emitter 2008 and the detector 2010 (or the combined emitter/detector 2810) may include electrical, magnetic, ultrasonic, optical detection methodologies and the passive target 2030 may include materials that are conductive, capacitive, inductive, reflective, opaque, etc. Where a capacitive sensor is used in conjunction with the second embodiment (i.e., combined emitter/detector 2810), the second portion 2102 coupled to the gate may be unnecessary, since the movement of the rail (32B for crib 22 or 142 for crib 132) of the gate by itself may be detectable by the capacitive sensor (where the emitter/detector 2810 is coupled to the crib frame) without the need for any passive target 2030. Similarly, as discussed earlier with the first and second embodiments, the first and second portions can be configured to use the field disturber 2030 such that the detector activates on alignment of the first and second portions, or on the momentary passage of the two portions using the latch circuit. Thus, it is within the broadest scope of the invention to include the use of the field disturber 2030 in all of these configurations.

It should be understood that the phrase "crib frame" as used throughout this Specification covers all portions of the crib, including the mattress (e.g., 49 in FIG. 1) that is typically positioned on the crib mattress supporting means, but is meant to exclude the movable gate 26/136. Thus, where a second portion 2004/2104 of the CGPI 2000 is mounted or mountable to the frame of the crib 22 this implies that the second portion 2004/2104 could be mounted, for example, on the side of the mattress.

It should be noted that the present invention 2000 (including all of the embodiments and variations discussed previously) is not limited to use on a crib (e.g., those cribs 22 and 132) but can be used with hospital beds where a gate/guard is moveably coupled to the bed frame. Anytime the gate is opened, the present invention 2000 provides a visual and/or audible alert that the gate is opened. As described earlier, the first portion 2002/2102 can be coupled to the gate and the second portion 2004/2104 can be coupled to the bed frame, or vice versa, without deviating from the scope of the invention.

Moreover, the present invention 2000 (including all of the embodiments and variations discussed previously) can be coupled to at a doorway or gate entrance where there is a moveable member, e.g., the door or gate, and a fixed member, e.g., a door frame or gate frame; the phrase "gate frame" includes any fixed part of an enclosure (e.g., a fence) that the movable gate acts as an ingress/egress location for the enclosed area. For example, the gate frame may include the portion of the enclosure to which the movable gate is hinged or otherwise movably coupled to; alternatively, the gate frame may include that portion of the enclosure that is closed off by the movable gate when the movable gate is in a closed position. Anytime the moveable member is opened, the present invention provides a visual and/or audible alert that the moveable member is opened away from the fixed member. As described earlier, the first portion 2002/2102 can be coupled to the moveable member and the second portion 2004/2104 can be coupled to the fixed member, or vice versa, without deviating from the scope of the invention. Furthermore, the use of the hook-hook means or hook-pile means, discussed earlier, makes the use of the present invention 2000 easily adaptable at any doorway or gate entrance.

Figure 11:
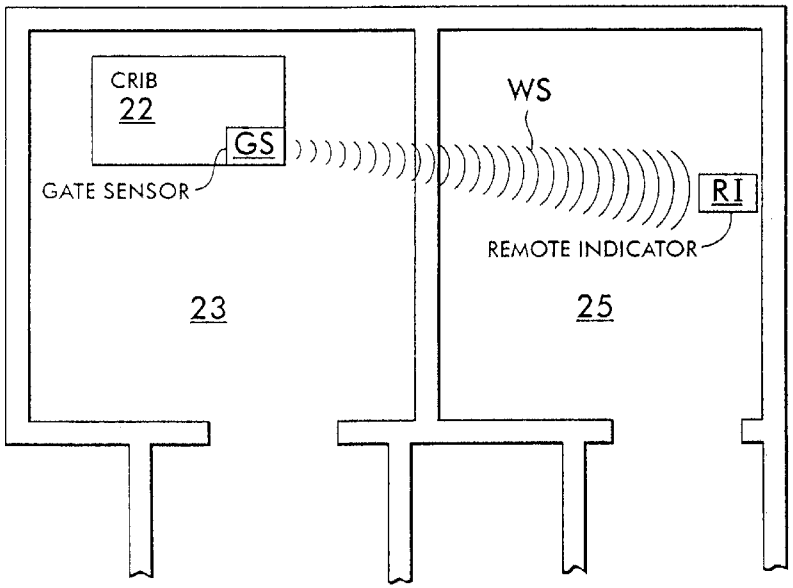
FIG. 11 is top plan view of a home showing a modified crib gate position indicator which uses a gate sensor coupled to a conventional baby crib which is at one location in the home and a remote indicator which is positioned at another remote location in the home.
Figure 12D:
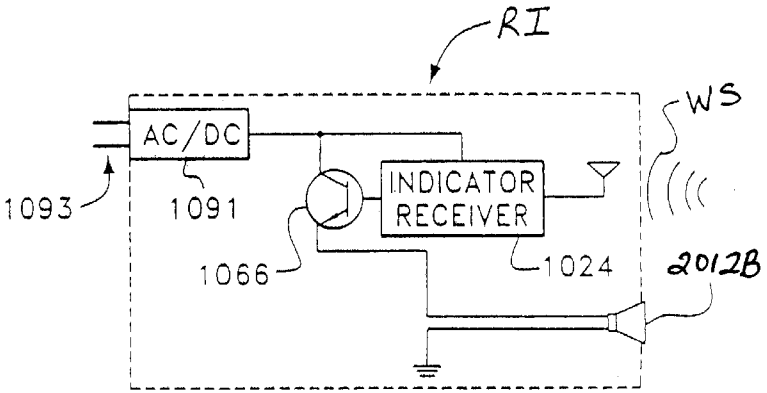
FIG. 12D is a functional diagram of the remote indicator including the audible indicator.
Figure 12C:
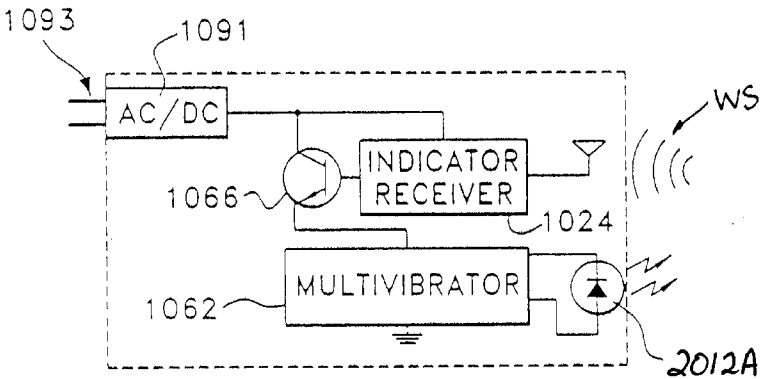
FIG. 12C is a functional diagram of the remote indicator including the visual indicator.

The present invention 2000 described in FIGS. 1–10 can be further modified as set forth in FIGS. 11–12C to provide the indication/alert of the crib gate open condition at a remote location. In general, as shown in FIG. 11, the first and second portions 2002/2004 (or 2102/2104) are together referred to as "gate sensor GS" while the visual and/or audible indicator 2012 is located in a remote indicator RI. For example, the gate sensor GS is coupled to a crib 22 located in a baby room 23 and the remote indicator RI (e.g., a dedicated remote indicator, a parent unit of a baby monitoring system including a crib gate open indicator, as will be described later, etc.) positioned at another Location 25, remote from the crib 23. When the crib gate 26/136 is moved into an open position, the gate sensor GS detects this open condition and then transmits a wireless signal WS to the remote indicator RI to alert the parent or caregiver to close the crib gate 26/136; once the gate 26/136 is closed, the visual and/or audible indicator 2012 is de-activated. It should be understood that the gate sensor GS comprises all of the embodiments and variations thereof discussed earlier with respect to the first and second portions 2002/2004 and 2102/2104 disclosed in FIGS. 1–10, such as but not limited to alignment detection, momentary detection, field disturbance detection as well as the various types of signals that can be used for non-contact detection.

In particular, the indicator 2012 in the second portion 2004 (or 2104) is replaced with a transmitter T (see FIGS. 12A and 12B, respectively) and the visual indicator 2012A (FIG. 12C) and/or the audible indicator 2012B (FIG. 12D) is placed in the remote indicator RI. As shown in FIG. 12C, the RI further comprises an indicator receiver 1024 that is coupled to the base of a transistor 1066 and whose emitter is coupled to a multivibrator 1062 which in turn is coupled to ground; the collector of the transistor 1066 is coupled to the power source, e.g., DC voltage provided by an AC/DC converter 1091. The RI further comprises a conventional plug 1093 that permits the indicator RI to be plugged into any electrical wall throughout the home. The output of the multivibrator 1062 is coupled to the visual indication means 2012A; if the audible indication means 2102B is used, the emitter of the transistor 1066 may be coupled directly to the audible indication means 2012B. Alternatively, the RI may comprise a portable unit, comprising its own power source (e.g., a 9 VDC battery) that does not require the use of any electrical wall outlet and, therefore, can be placed anywhere and operate. It should be noted that the remotely-located indicator RI can also include a baby unit of a baby monitoring system, i.e., the indicator receiver 1024/indicator 2012A or 2102B can be part of the baby unit that is positioned near the crib 22.

Operation of the GS and RI is as follows. When the crib gate 26/136 is opened, the detector 2010 (or 2010') detects the opened gate 26/136 and then activates the transmitter T (e.g., Micrel's MICRF102 transmitter, Linear Alert Receiver Model No. D-8C and associated transmitter, etc.,) which transmits the signal WS (e.g., a wireless signal in the unlicensed ISM (Industrial, Scientific and Medical) band, e.g., 300–900 MHz range or above (e.g., 2.4 GHz) where low power, wireless transmission is permitted for home use). The signal WS is received by the indicator receiver 1024 (e.g., Micrel's MICRF002 receiver, Linear Alert Receiver Model No. D-8C, etc.,) which then turns on the transistor 1066 which in turn activates the multivibrator 1062. This causes the visual indicator means 2012A to flash, thereby warning the parent or caregiver in view of the RI to go to the crib 22 and close the gate 26/136. Once the gate 26/136 is closed, the gate sensor GS de-activates the transmitter T. Alternatively, if the audible indication means 2012B is used, the turning on of the transistor 1066 causes the audible indication means 2012B to emit the audible signal 2012B' (e.g. a humming, a whistle, a statement, a tune, etc.) that can be heard by the parent or caregiver causing them to again corrective action, i.e., close the crib gate 26/136. Once the gate 26/136 is closed, the gate sensor GS de-activates the transmitter T.

It should be understood that the present invention 2000 as shown in FIGS. 11–12D is by way of example only and that like the present invention 2000 shown in FIGS. 1–10, is not limited to coupling the crib having the displaceable gate 26 but can be coupled to any crib having a moveable gate and that the first and second portions 2002/2004 (or 2102/2104) of the gate sensor GS can be interchanged as discussed previously. Furthermore, as discussed previously with regard to FIGS. 1–10, the invention of FIGS. 11–12D can also be coupled at a doorway or gate entrance where there is a moveable member, e.g., the door or gate, and a fixed member, e.g., a door frame or gate frame but with the added feature of having the door/gate open indication being provided remotely and wirelessly. In addition, the use of the hook-hook means or hook-pile means, discussed earlier, makes the use of the present invention of FIGS. 11–12D easily adaptable at any doorway or gate entrance.

FIGS. 13–24 depict a unique baby monitoring system 1120 that includes a crib gate position indication. This system 1120 allows the sounds of a baby located in the crib 22/132 to be heard at a remote location while simultaneously providing a crib gate "open" alert at that remote location also. It should be understood that it is within the broadest scope of this invention to include any type of baby monitoring system, both audio or visual or any combination of the two. Whichever baby monitoring system is used, the common features of these systems are that they include (1) a unit for detecting the sounds of, and/or the image of, the baby and his/her immediate surroundings and then transmitting a wireless signal corresponding thereto, hereinafter referred to as the "baby unit"; and (2) a remotely-located receiver for receiving the transmitted signal that permits the listening to the sounds of, and/or the watching of, the baby and his/her immediate surroundings, hereinafter referred to as the "parent unit." In the present application, the invention is described in terms of an audio-type baby monitoring system for listening to the sounds of the baby. But it should be remembered that the present invention is not limited to such a baby monitoring system and includes all other types.

Figure 13:
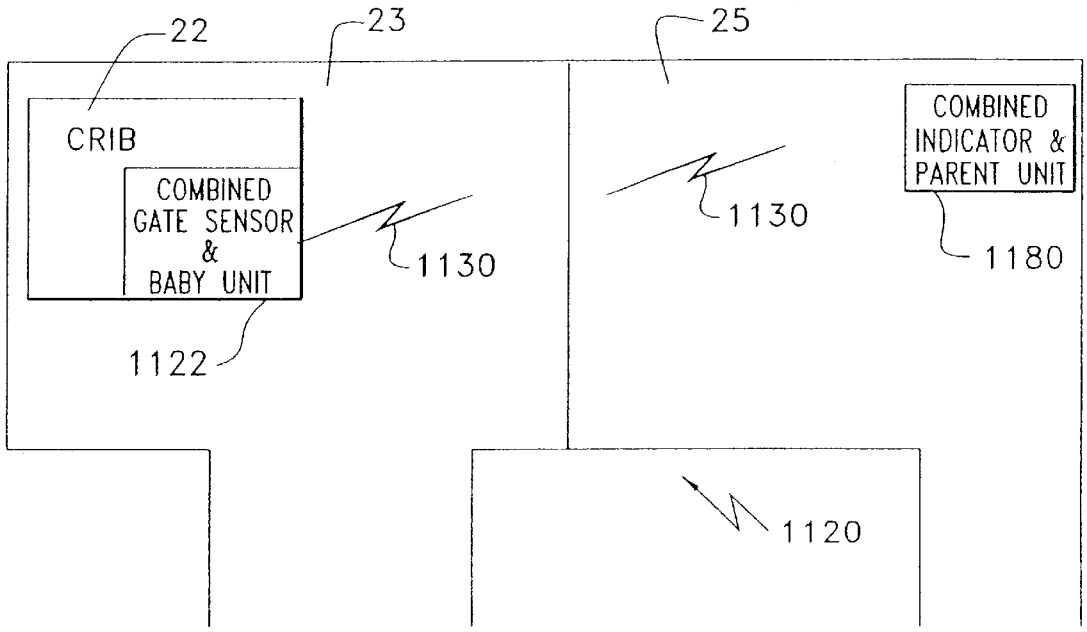
FIG. 13 is a top plan view of a home showing a baby monitoring system that includes the crib gate position indicator wherein a combined gate sensor/baby unit is coupled to a conventional baby crib which is at one location in the home and a combined indicator/parent unit which is positioned at another remote Location in the home.

In particular, the system 1120 (FIG. 13) includes a combined gate sensor and baby unit 1122 (FIG. 14 or FIG. 15) which comprises the gate sensor GS combined with the elements (e.g., microphone 1153) of a conventional baby unit of a baby monitoring system. The system 1120 also comprises a combined indicator and parent unit 1180 (FIG. 13) which comprises the indicator (2012A or 2012B) combined with the elements (e.g., speaker 1181) of a conventional parent unit of a baby monitoring system. FIG. 13 depicts an exemplary configuration of the system 1120 wherein the combined gate sensor/baby unit 1122 is coupled to the crib 22/132 in a first room 23 and the combined indicator/parent unit 1180 is remotely-located in another room 25. Transmission of the baby sounds occurs regardless of the condition of the crib gate 26/136 in all of the embodiments discussed below.

As will be discussed in detail later, the combined gate sensor/baby unit 1122 basically comprises the first and section portions 2002/2004 (or 2102/2104) which includes the detector 2010 (or 2010') for detecting the open condition of the gate 26/136 and a sound sensor 1153 (e.g., microphone, or any equivalent device that converts sound into electrical signals) for detecting the sounds of the baby. The combined gate sensor/baby unit 1122 then generates a wireless signal 1130 which is received by the combined indicator/parent unit 1180. Furthermore, the combined indicator/parent unit 1180 basically comprises the visual indicator 2012A and/or audible indicator 2012B for alerting the parent or caregiver of the open condition of the gate 26/136 and a sound transducer 1181 (e.g., a speaker, or any equivalent device that converts electrical signals to sound) for providing the sounds of the baby in the crib 22/132 to the parent or caregiver. Upon receipt of the signal 1130, the combined indicator/parent unit 1180 operates the indicator 2012A and/or 2012B and the parent unit speaker 1181 accordingly, as will be discussed in detail below.

Figure 12A:
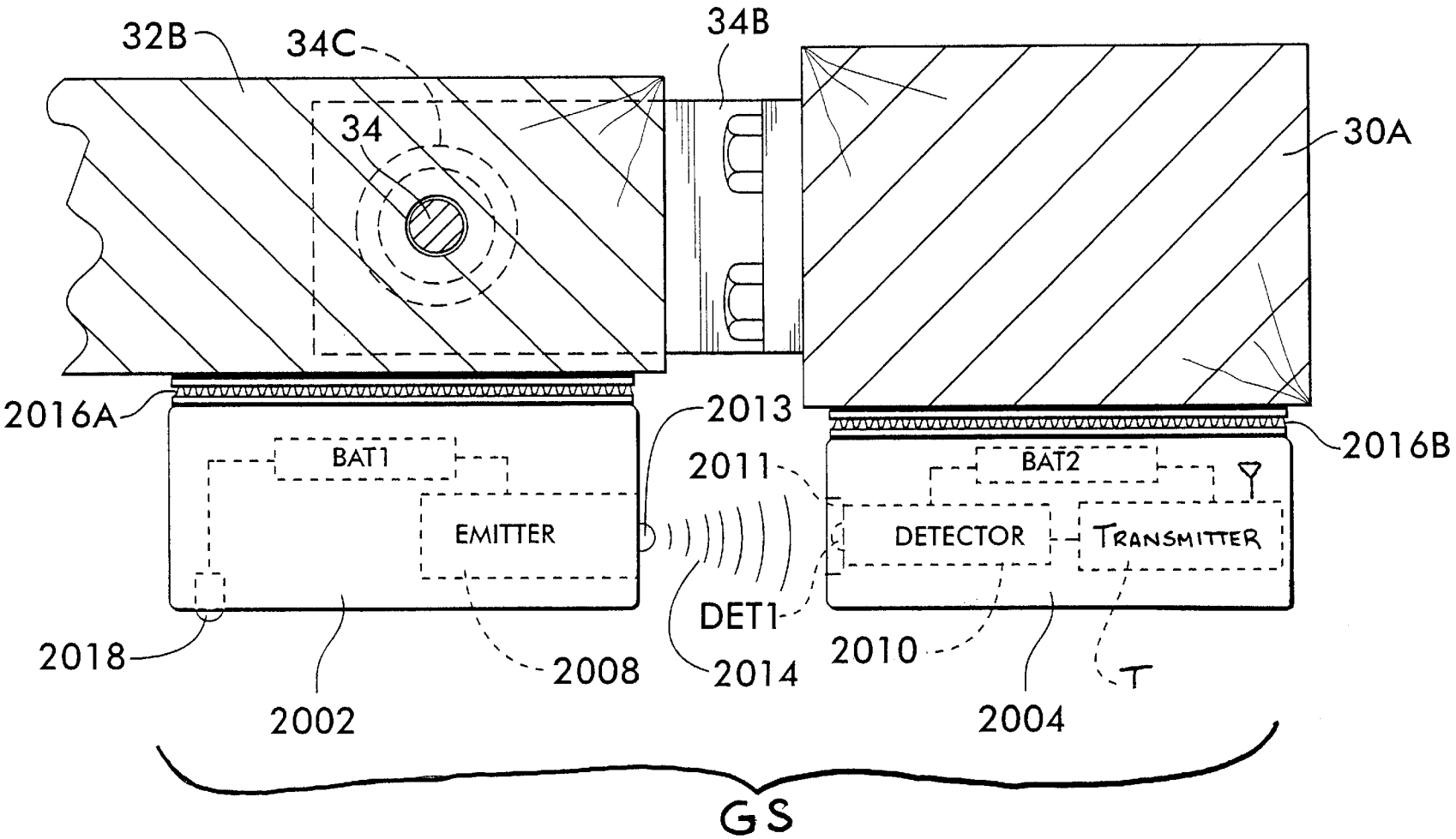
FIG. 12A is an enlarged view of the gate sensor, similar to FIG. 4 but with the indicator replaced by a transmitter.
Figure 12B:
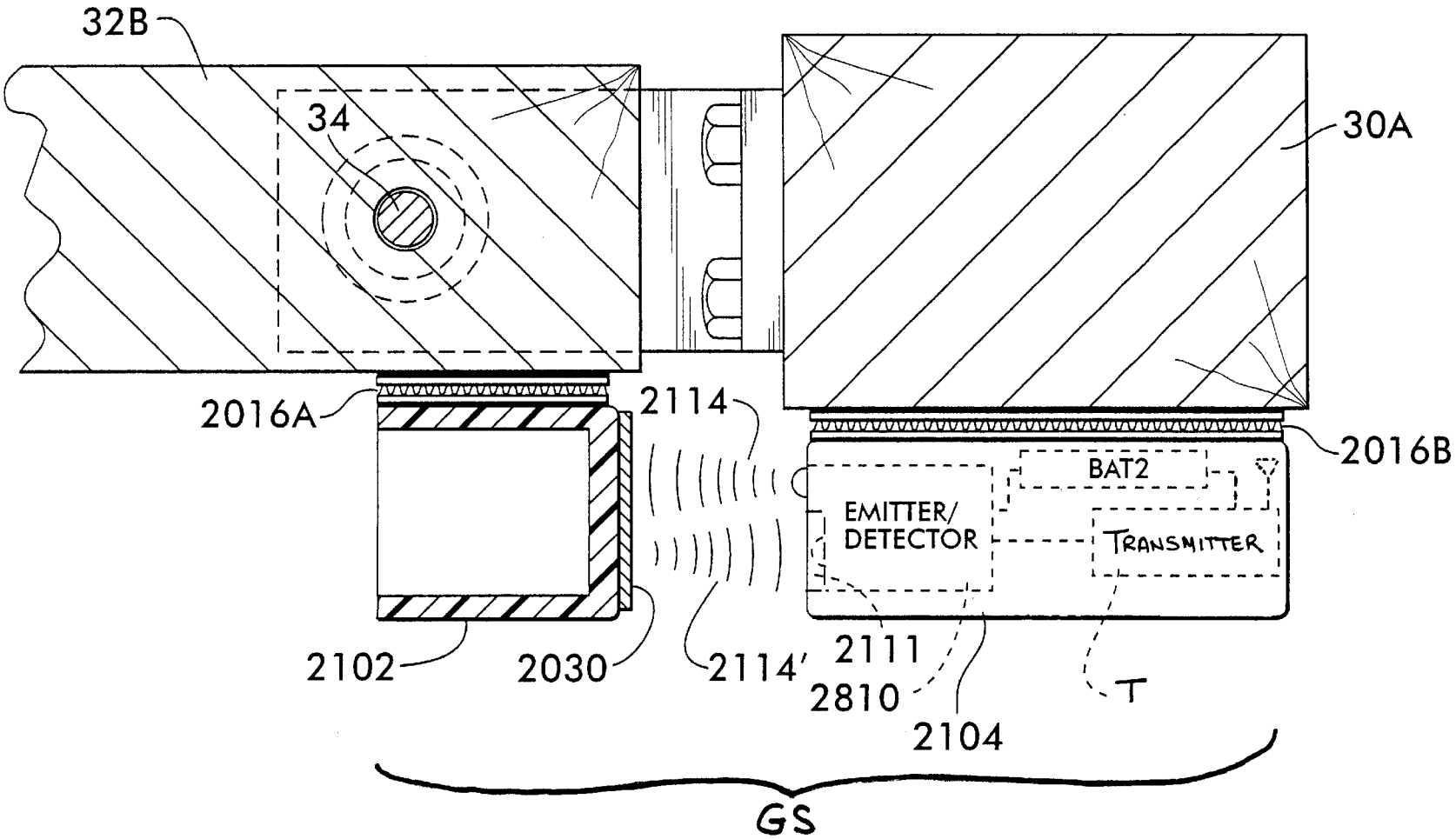
FIG. 12B is an enlarged view of the gate sensor, similar to FIG. 5 but with the indicator replaced by a transmitter.
Figure 14:
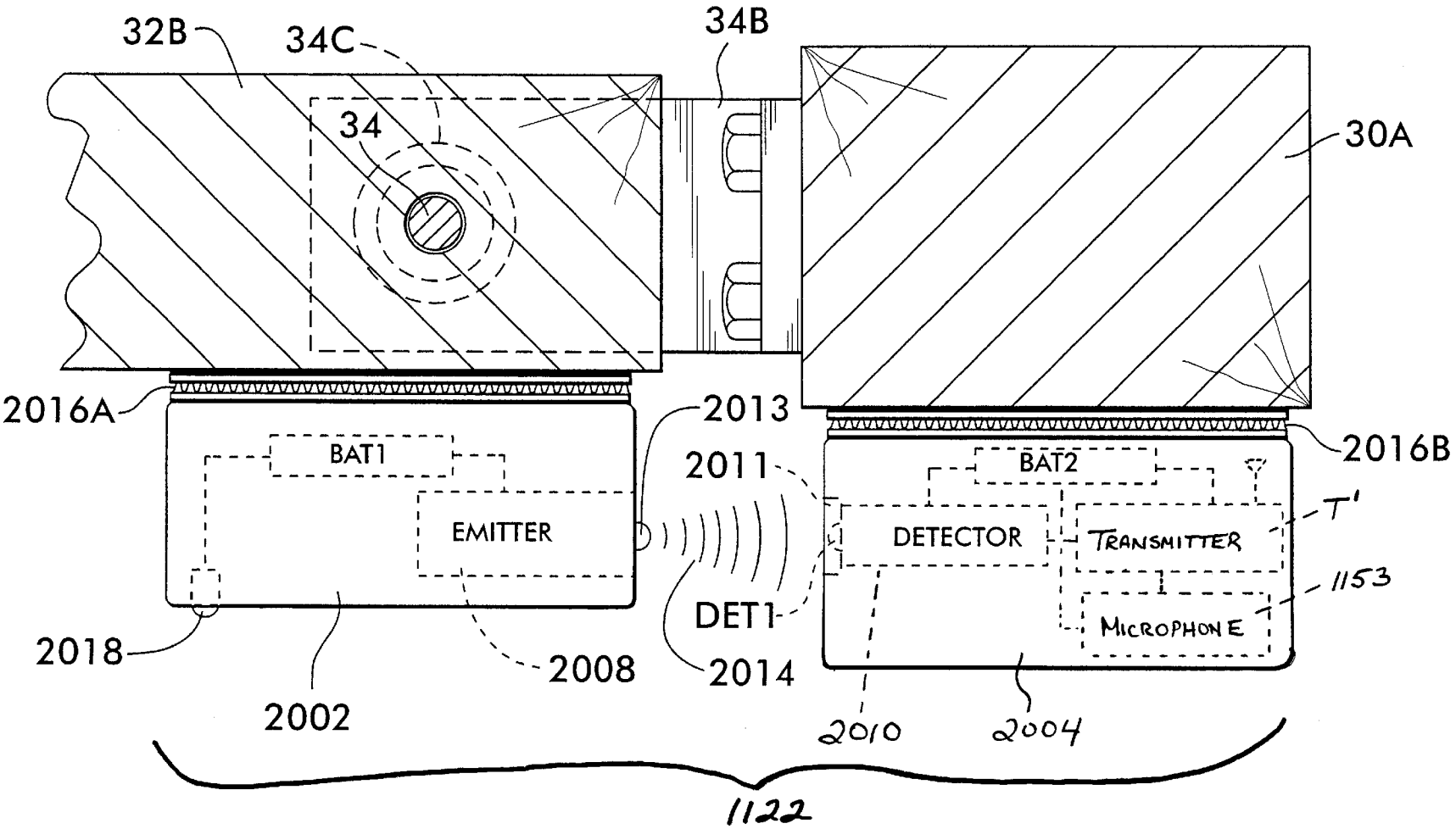
FIG. 14 is an enlarged view of the combined gate sensor/baby unit, similar to FIG. 4 but with the indicator replaced by a transmitter and microphone.
Figure 15:
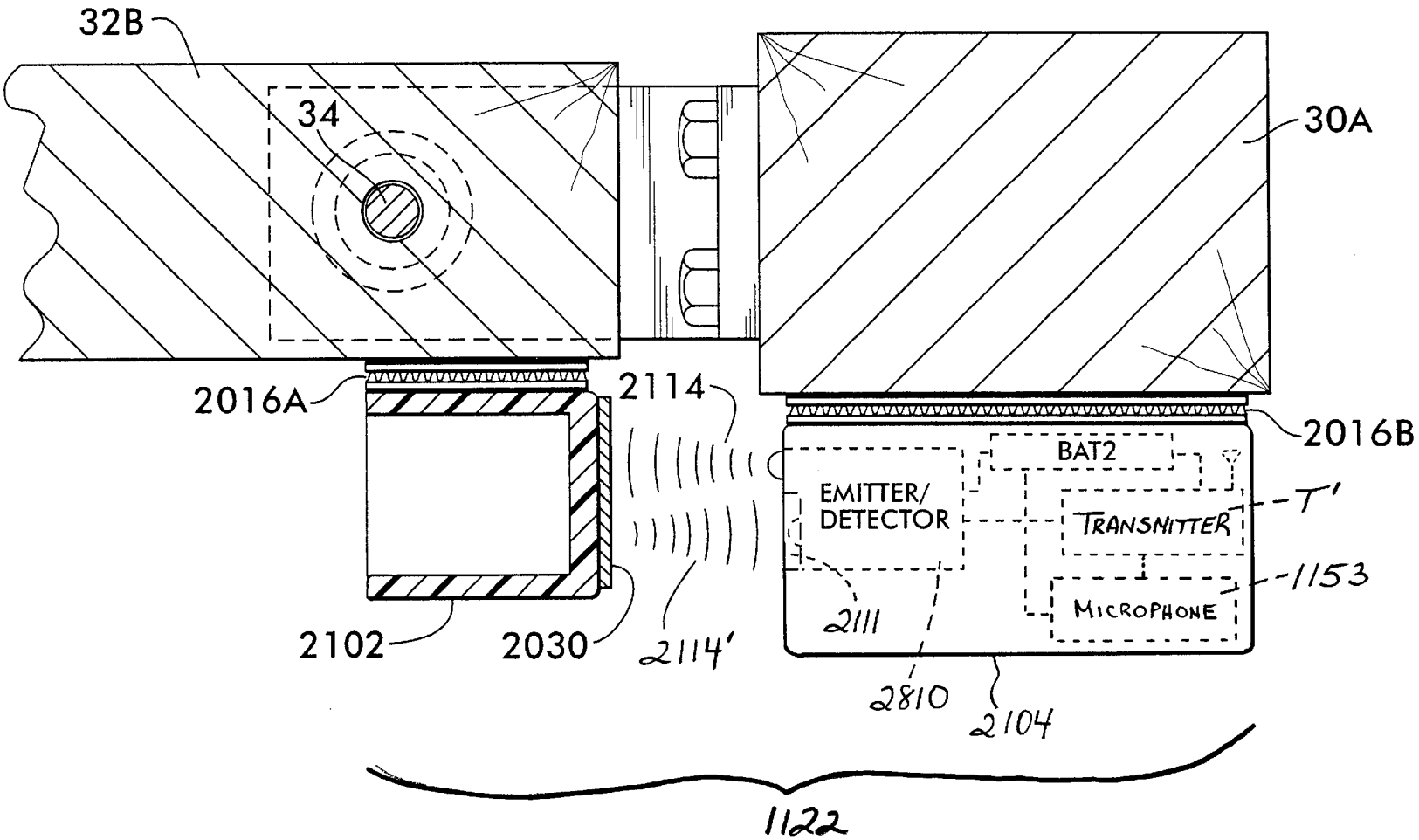
FIG. 15 is an enlarged view of the combined gate sensor/baby unit, similar to FIG. 5 but with the indicator replaced by a transmitter and microphone.

FIGS. 14–15 depict how the gate sensor GS of FIGS. 12A–12B can be modified to form the gate sensor 1122. FIGS. 16–24 provide functional diagrams of different embodiments of the combined gate sensor/baby unit (hereinafter "gate sensor 1122") and the combined indicator and parent unit 1180 (hereinafter "RI 1180") that form the unique baby monitoring system 1120 (hereinafter "system 1120").

Figure 18:
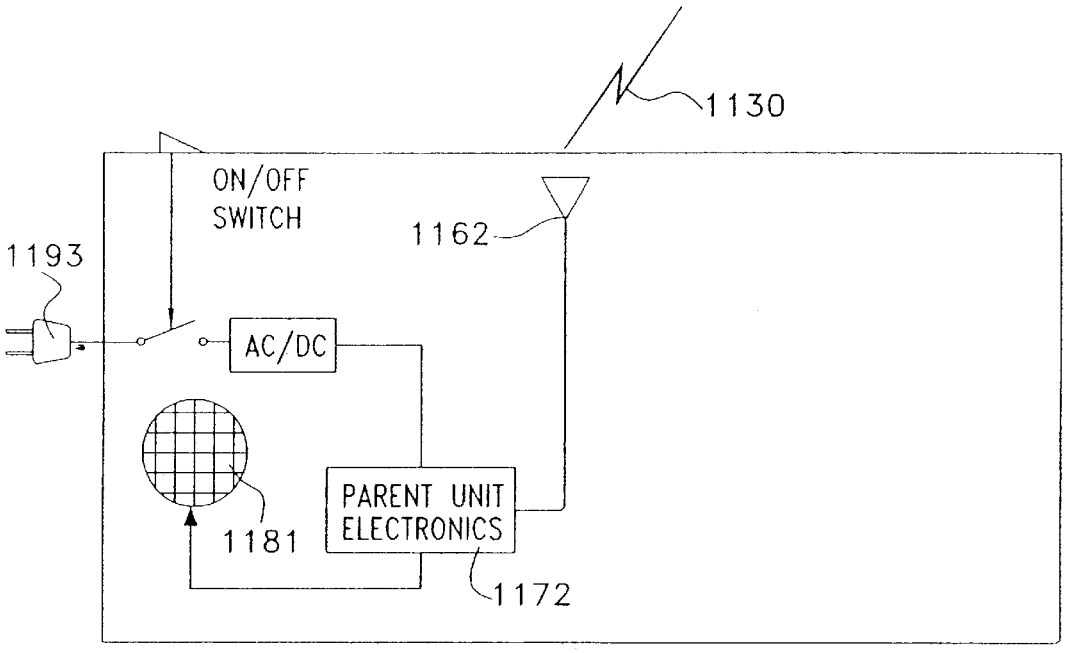
FIG. 18 is a functional diagram of an alternative embodiment of the combined indicator/parent unit of FIG. 17 of the baby monitoring system.
Figure 16:
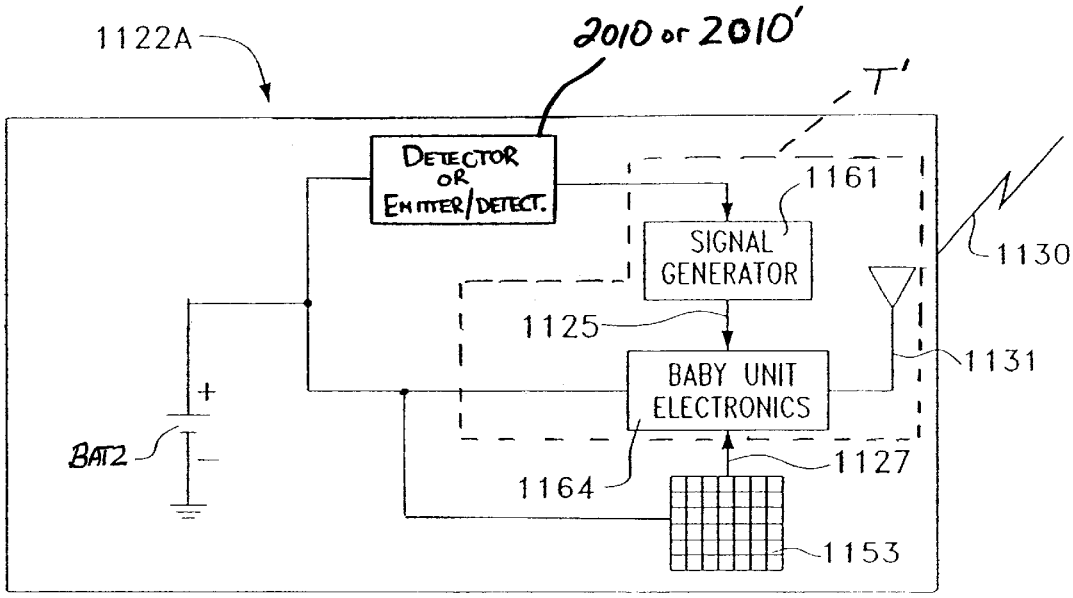
FIG. 16 is a functional diagram of a first embodiment of the combined gate sensor/baby unit of either FIG. 14 or FIG. 15.
Figure 17:
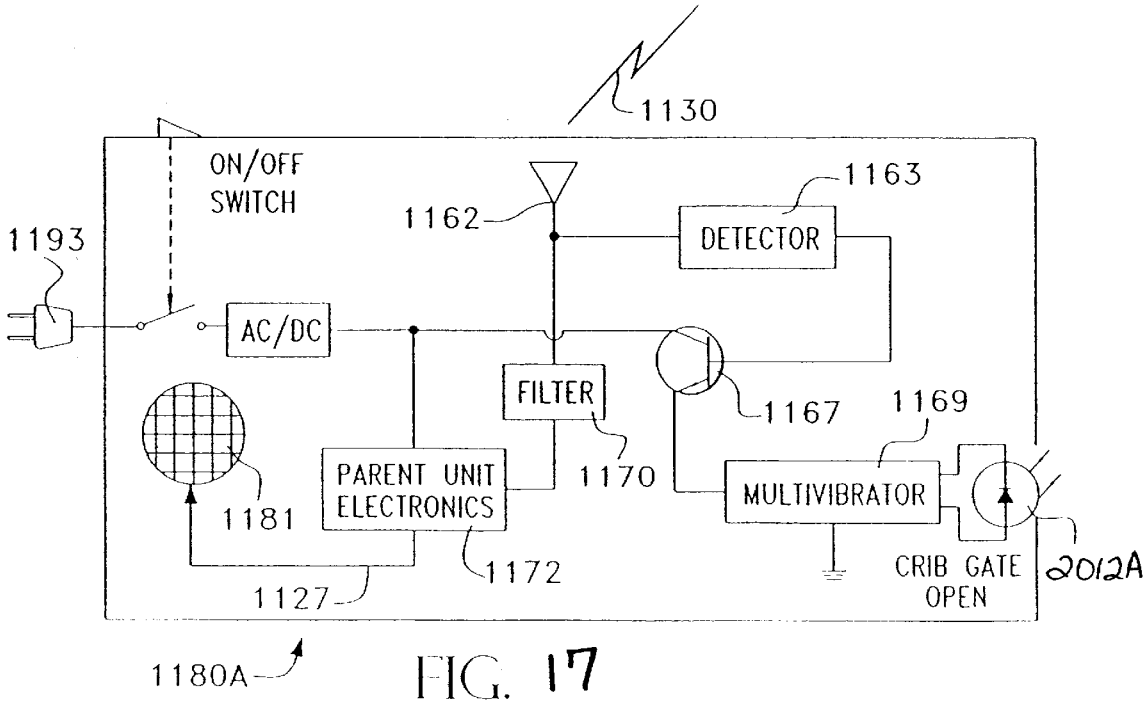
FIG. 17 is a functional diagram of a first embodiment of the combined indicator/parent unit of the baby monitoring system.
Figure 19:
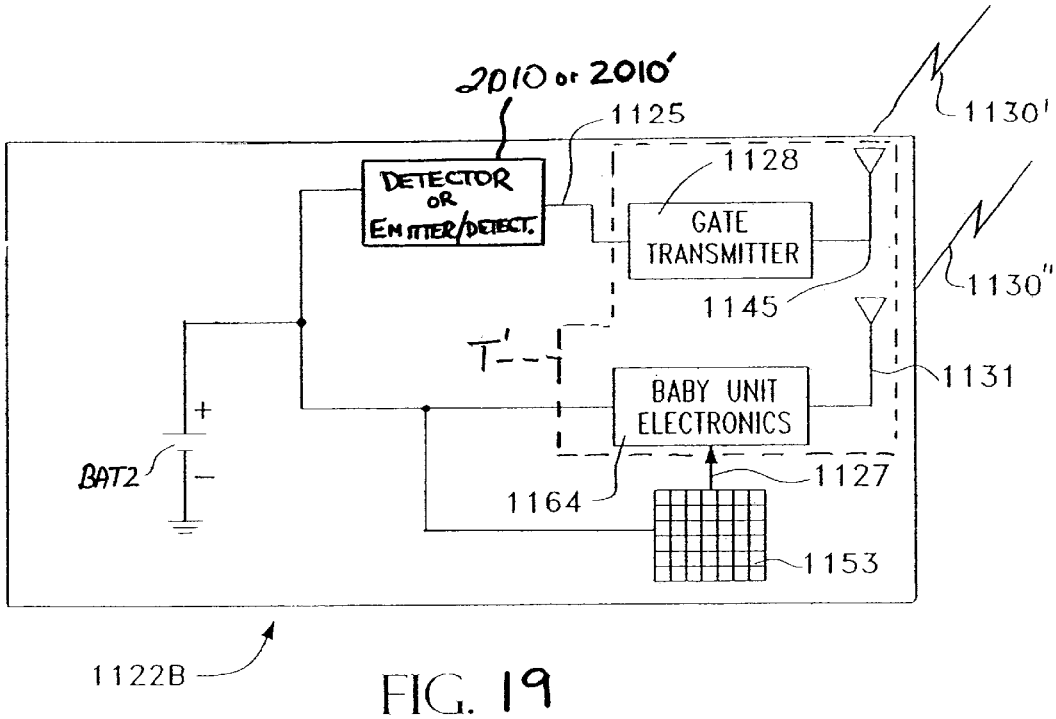
FIG. 19 is a functional diagram of a second embodiment of the combined gate sensor/baby unit of either FIG. 14 or FIG. 15.
Figure 20:
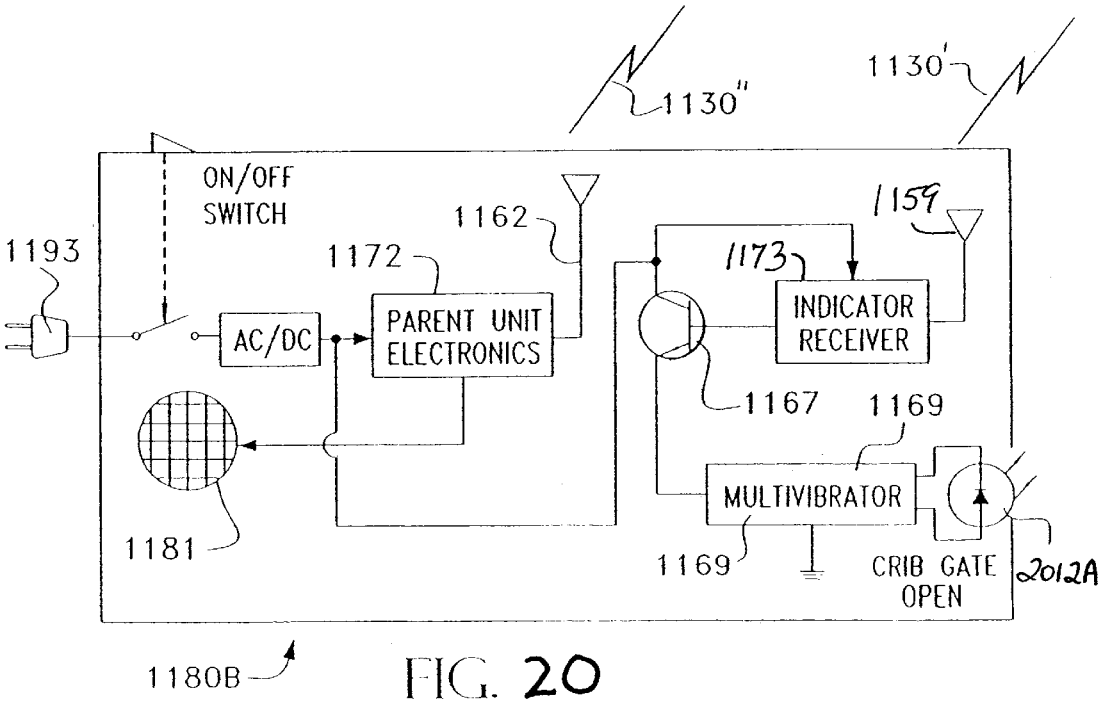
FIG. 20 is a functional diagram of a second embodiment of the combined indicator/parent unit of the baby monitoring system.
Figure 21:
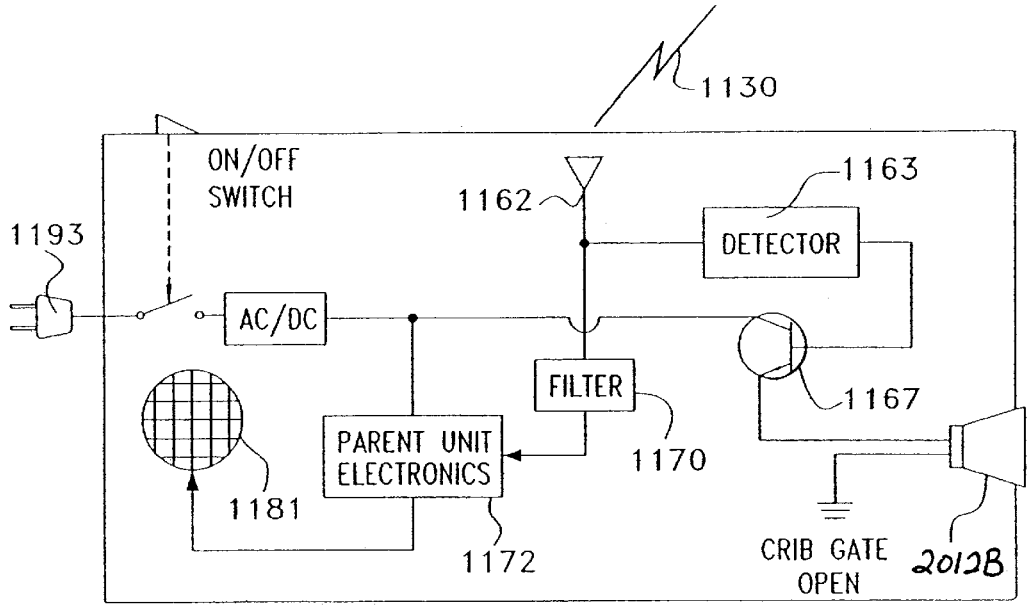
FIG. 21 is a functional diagram of the first embodiment of the combined indicator/parent unit using an audible indicator.
Figure 22:
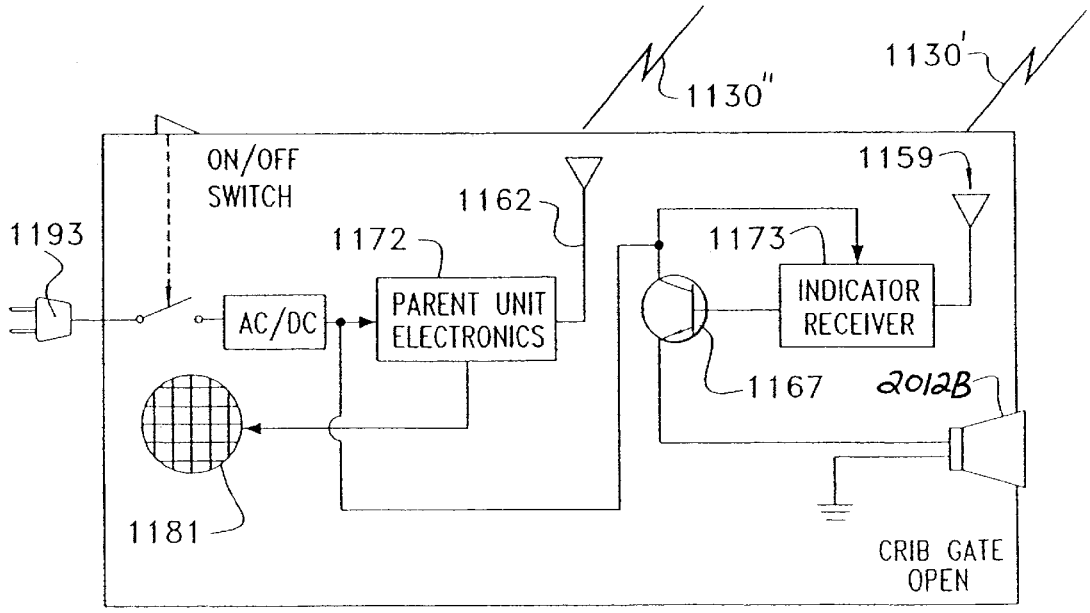
FIG. 22 is a functional diagram of the second embodiment of the combined indicator/parent unit using an audible indicator.

The first embodiment of the system 1120 comprises the combined gate sensor/baby unit 1122A shown in FIG. 16 as well as a corresponding combined indicator/parent unit 1180A shown in FIG. 17, or an alternative combined indicator/parent unit 2180A (FIG. 18). A second embodiment of the system 1120 comprises the combined gate sensor/baby unit 1122B shown in FIG. 19 as well as a corresponding combined indicator/parent unit 1180B shown in FIG. 20. Generally, in the first embodiment, when the combined gate sensor/baby unit 1122A generates a signal 1125 representative of the open condition of the crib gate 26/136, that signal is combined with the conventional baby unit signal 1127 (i.e., the baby sounds, baby room environment, etc.) to form the signal 1130 that is wirelessly transmitted. The signal 1130 is received by the combined indicator/parent unit 1180A which then demodulates the signal 1130 into the signal 1125 (if present in the signal 1130) that drives the visual indicator 2012A and/or audible indicator 2012B and the conventional baby unit signal 1127 that drives the speaker 1181; alternatively, the alternate combined indicator/parent unit 2180A can be used where the signal 1130 is played out through a speaker 1181 so that both the baby unit signal 1127 and the crib gate open signal 1125 are heard together; the presence of the crib gate open signal 1125 causes an audible variation (e.g., hum or loud static over the baby sounds) in the baby sound signal that can be heard by a parent or caregiver to alert that person that the crib gate 26/136 is open. In contrast, in the second embodiment, the wireless signal actually comprises two independent signals 1130' and 1130" which correspond to the crib gate open signal 1125 and the conventional baby unit signal 1127, respectively.

With particular respect to the first embodiment, i.e., the combined gate sensor/baby unit 1122A and combined indicator/parent unit 1180A, the combined gate sensor/baby unit 1122A operates as follows: When the detector 2010 (or 2010') detects the opened gate 26/136, it activates a signal generator 1161 (e.g., a square wave, a triangle wave, or even just a DC bias from the power source 1160 itself, etc.). This signal generator 1161 generates the crib gate open signal 1125 that is passed to the conventional baby unit electronics 1164, which includes a modulation means (not shown). As a result the crib gate open signal 1125 is modulated along with the conventional baby sound signal 1127 from the microphone 1153 into the resultant wireless signal 1130 from an internal antenna 1131. It should be understood that where the crib gate 26/136 is left in a closed position and the detector 2010 (or 2010') is not otherwise detecting an open condition, there is no crib gate open signal 1125 generated and the only signal being carried by the wireless signal 1130 is the conventional baby sound signal 1127.

Upon receipt of the wireless signal 1130 by a receiver antenna 1162, the signal 1130 is monitored by a detector 1163 in the combined indicator/parent unit 1180A for the crib gate open signal 1125. If the crib gate open signal 1125 is present in the signal 1130, the detector 1163 turns on a transistor 1167 that activates a multivibrator 1169 which drives the visual indicator 2012A, thereby warning the parent or caregiver in view of the remotely-located indicator 1180A to go to the crib 22 and close the gate 26. Once the gate 26/136 is closed, the detector 2010 (or 2010') no longer detects the open gate 26/136 condition and, therefore, no crib gate open signal 1125 generated. Furthermore, the signal 1130 is then filtered by a filter 1170 to remove the crib gate open signal 1125, if present. The signal emerging from the filter 1170 contains the conventional baby sound signal 1127 which is passed to the parent electronics 1172 where it is demodulated and then played out by the speaker 1181.

The modulation means in the baby unit electronics 1164 in the combined gate sensor/baby unit 1122A can be any conventional modulation means used in the wireless transmission of a typical baby monitor signal with the added ability to further modulate the carrier signal (e.g., unlicensed ISM (Industrial, Scientific and Medical) band, e.g., 300–900 MHz range or above, e.g., 2.4 GHz, etc., where low power, wireless transmission is permitted for home use) with the signal 1125 when present. Similarly, the demodulating means used in the parent unit electronics 1172 in the combined indicator/parent unit 1180A can be any conventional demodulation means used in the reception of a wirelessly transmitted baby monitor signal for demodulating the received signal 1130 into the baby sound signal 1127.

An alternative combined indicator/parent unit 2180A is shown in FIG. 18. In this alternative embodiment, the parent unit electronics 1172 deliver the signal 1130, including the embedded signal 1125 (if present) to the speaker 1181. The result played out by the speaker 1181 is the sounds of the baby, or baby room environment with an audible variation (e.g., hum, or loud static over the baby sounds or baby room environment, or other irritating or distorting sounds) that can be clearly detected by the parent or caregiver, thereby alerting that person that the crib gate 26/136 is in an open condition. Once corrective action is taken (i.e., the crib gate 26/136 is closed), the crib gate open signal 1125 disappears and the audible variation terminates. As a result, the baby sounds/baby environment sounds can then be heard clearly from the speaker 1181.

With particular respect to the second embodiment, i.e., the combined gate sensor/baby unit 1122B (FIG. 19) and combined indicator/parent unit 1180B (FIG. 20), the combined gate sensor/baby unit 1122B operates as a follows: When the detector 2010 (or 2010') detects the opened gate 26/136, it activates a gate transmitter 1128 (e.g., Micrel's MICRF102 transmitter, Linear Alert Receiver Model No. D-8C and associated transmitter, etc.,), which emits a "crib gate open" signal 1130' from an antenna 1145 toward the remotely-located, combined indicator/parent unit 1180B. Simultaneously, the baby unit electronics 1164 emits the conventional baby sound signal 1127 as the wireless signal 1130" also towards the remotely-located, combined indicator/parent unit 1180B via the antenna 1131.

The wireless signal 1130' is received by an indicator receiver 1173 (e.g., Micrel's MICRF002 receiver, Linear Alert Receiver Model No. D-8C, etc.,) via an antenna 1159 and the wireless signal 1130" is received by the parent unit electronics 1172 via the antenna 1162. The respective signals 1130' and 1130" are processed as follows: if signal 1130' is received, the indicator receiver 1173 turns on the transistor 1167 that activates the multivibrator 1169 which drives the indicator 2012A, thereby warning the parent or caregiver in view of the remotely-located indicator 1180B to go to the crib 22 and close the gate 26. Once the gate 26/136 is closed, the detector 2010 (or 2010') no longer detects the open gate 26/136 condition and, therefore, no crib gate open signal 1125 is generated. Simultaneously, the signal 1130" is passed to the parent electronics 1172 where it is demodulated and then played out by the speaker 1181. The remotely-located, combined indicator/parent unit 1180B comprises the visual indicator 2012A.

As with the first embodiment of the baby monitoring system 1120, the baby unit electronics 1164 and the parent unit electronics 1172 of the second embodiment operate as conventional baby monitoring system electronics (e.g., unlicensed ISM (industrial, Scientific and Medical) band, e.g., 300–900 MHz range or above, e.g., 2.4 GHz, etc., where low power, wireless transmission is permitted for home use; similar modulation and demodulation mechanisms, etc.).

It is contemplated by Applicants that the gate transmitter 1128/indicator receiver 1173 include logic for appending additional changeable coded information on the signal 1130' sent between them which can be employed to prevent interference between the use of the present invention 1120 and the baby monitor signal 1130" or other wireless devices (e.g., garage door openers, window alarms, etc.) in the area which might be affected thereby.

It should also be understood that although the indicator 2012A depicted in the combined indicator/parent units 1180A/1180B is a visual indicator (e.g., LED), this visual indicator could be replaced with the audible indicator or annunciator 2102B (FIG. 21 for the combined indicator/parent unit 1180A and FIG. 22 for the combined indicator/parent unit 1180B), e.g., speaker, 32 Ohm, 0.79", 2W, or Panasonic EFB-CB37C11 Ceramic Buzzer, which provide an audible warning. The audible indicator 2012B may even provide a more distinct sound/alarm to the parent or caregiver than the audible variation that emanates from the speaker 1181 in the combined indicator/parent unit 2180C (FIG. 18). For example, if the audible indicator 2012A is used, the turning on of the transistor 1167 causes the audible indicator 2012B to emit an audible signal (e.g. a humming, a whistle, a statement, a tune, etc.) that can be heard by the parent or caregiver causing them to take corrective action, i.e., close the crib gate 26/136. It should be understood that the multivibrator 1169 could be coupled between the transistor 1167 and the audible indicator 2012B to cause a wavering sound for the audible signal.

It should be further understood that both of the indicators, visual indicator 2012A and audible indicator 2012B, can be included in the combined indicator/parent units 1180A, 1180B and 2180A, as they are shown in second portions 2004 and 2104 in FIGS. 1–10. Moreover, the particular circuitries shown for activating these indicators 2012A/2012B are by way of example only. Thus, there are many ways to activate (continuous, flash-intermittent, wavering, etc.) these indicators which are included in the broadest scope of this invention. The key feature is that once the detector 2010 (or 2010') detects the open condition of the gate 26/136, the detector 2010 (or 2010') directly activates the indicators 2012A/2012B locally (FIGS. 1–10 or FIGS. 25–28 discussed below) or remotely (FIGS. 11–24) via the transmitter T or T'; conversely, once the detector 2010 (or 2010') no longer detects the open condition of the gate 26/136, the detector 2010 (or 2010') no longer activates these indicators 2012A/2012B'.

Figure 23:
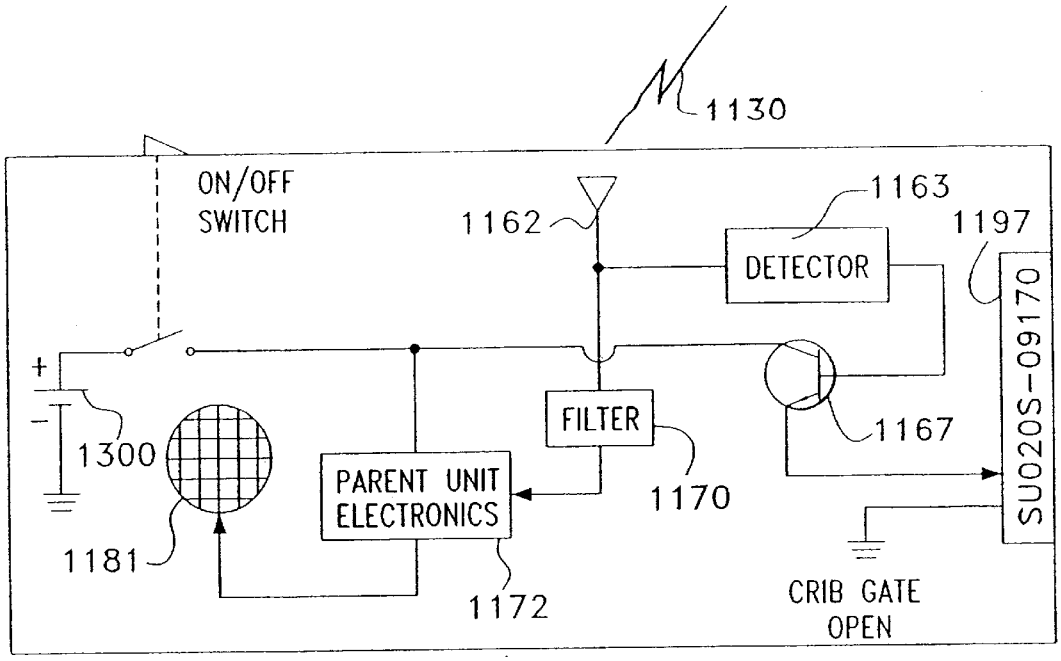
FIG. 23 is a functional diagram of the first embodiment of the combined indicator/parent unit using a tactile indicator.
Figure 24:
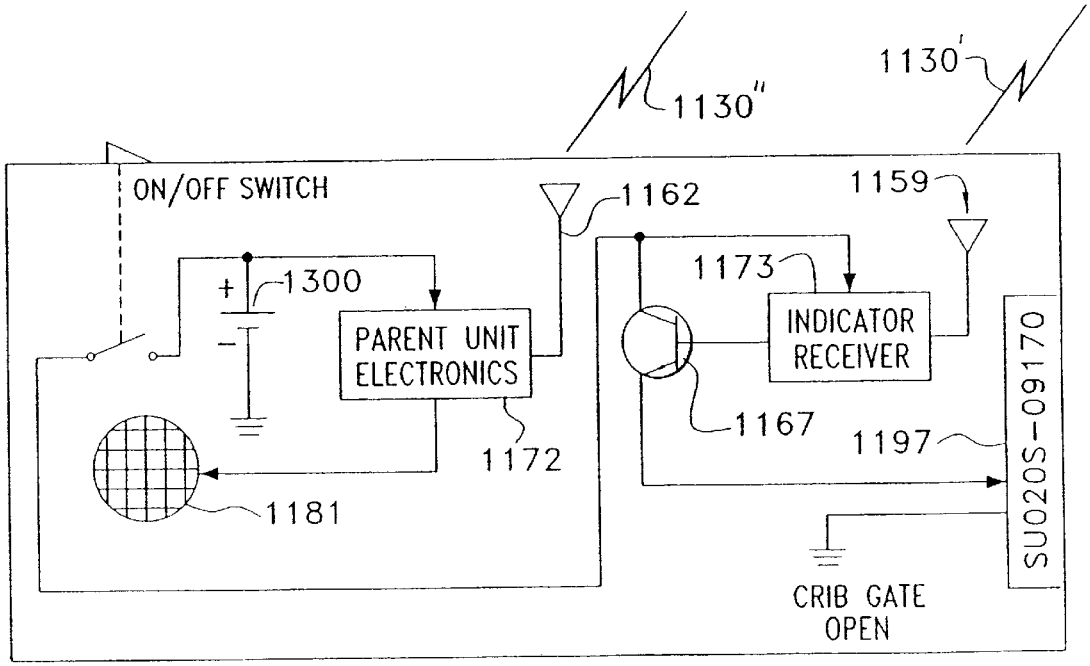
FIG. 24 is a functional diagram of the second embodiment of the combined indicator/parent unit using a tactile indicator.
Figure 25:
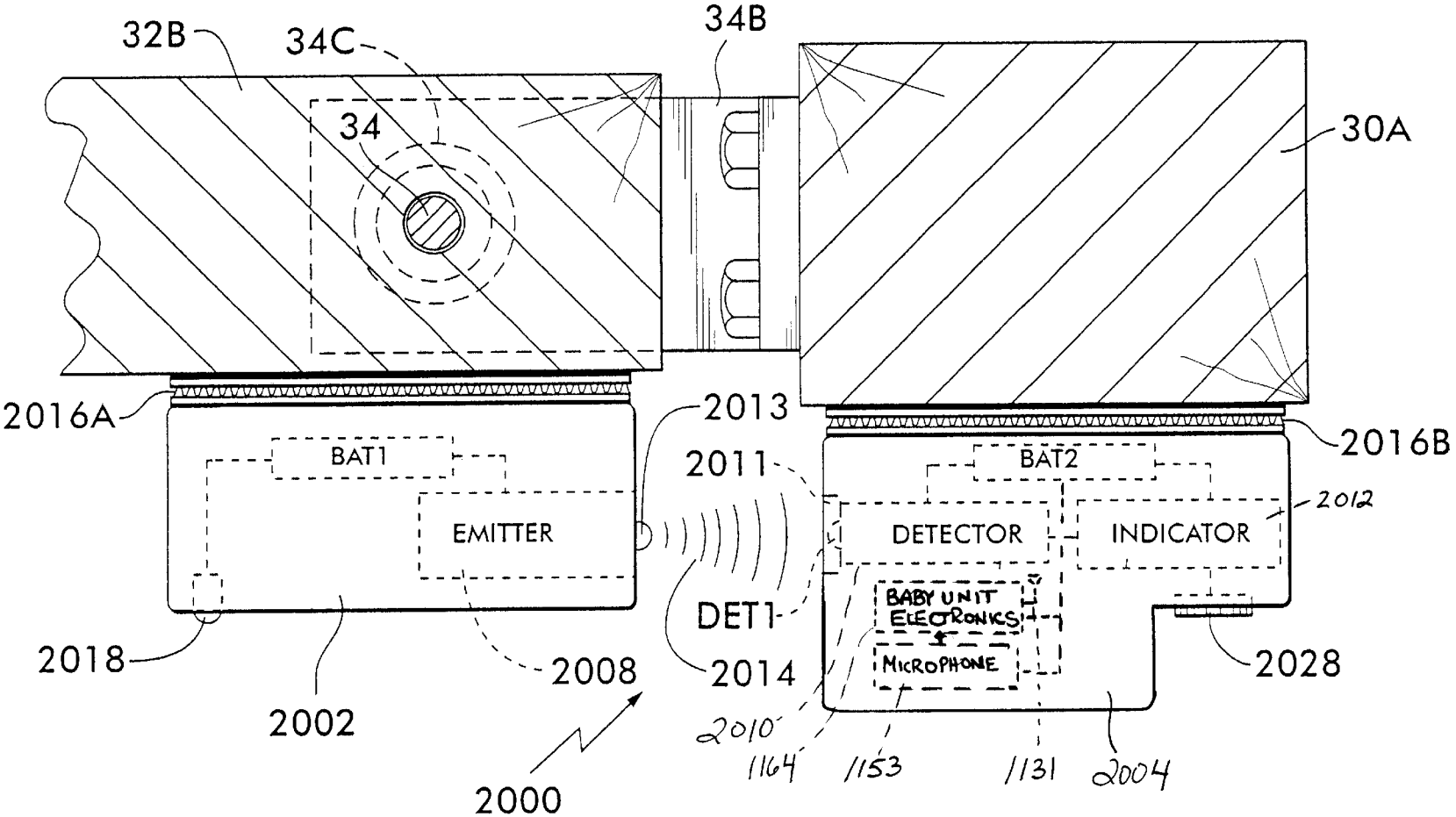
FIG. 25 is an enlarged view of the present invention of FIGS. 1–10, similar to FIG. 4, but including baby unit electronics, a microphone and antenna for wirelessly transmitting the sounds of the baby to a remotely-located parent unit.
Figure 26:
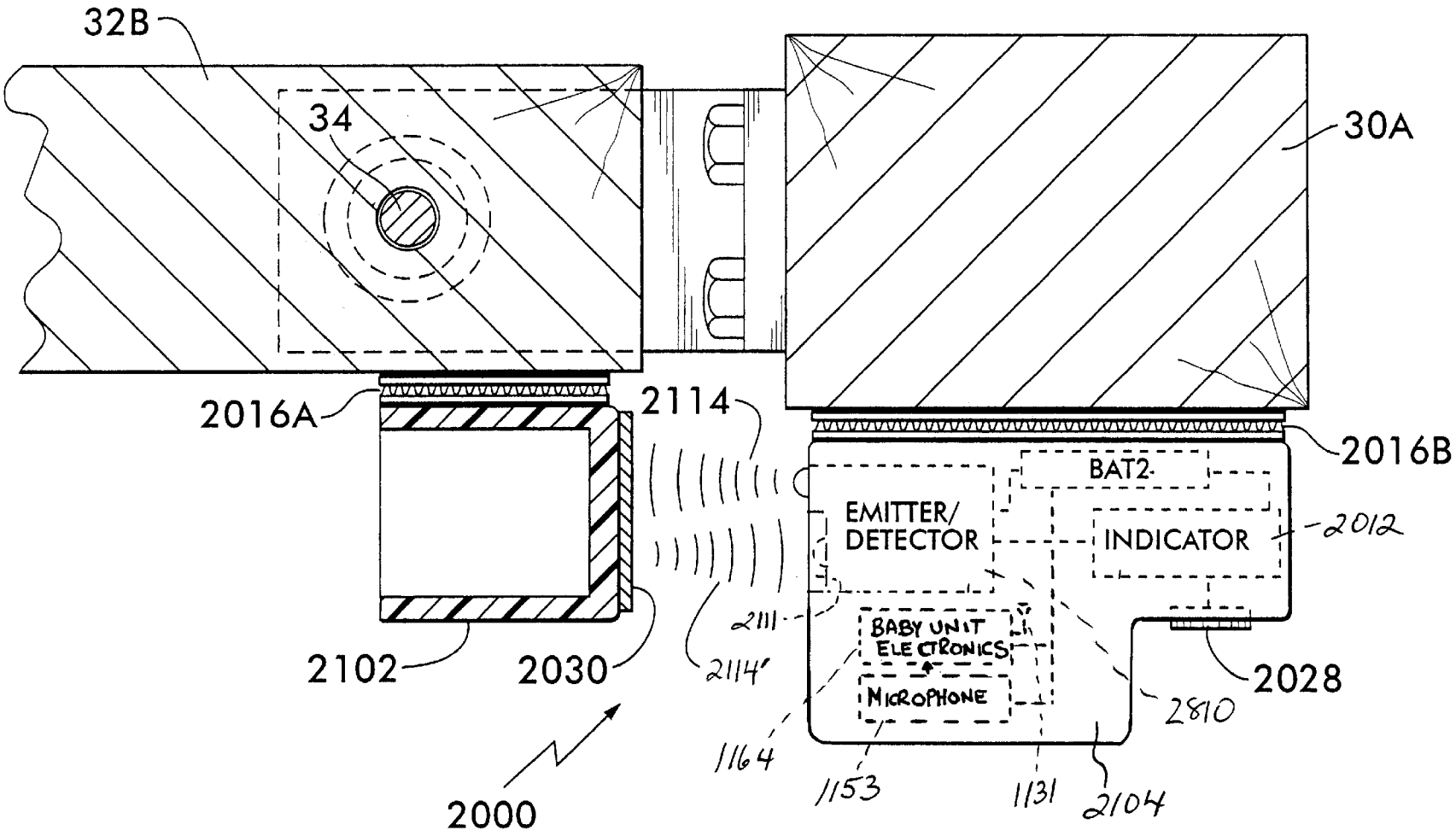
FIG. 26 is an enlarged view of the present invention of FIGS. 1–10, similar to FIG. 5, but including baby unit electronics, a microphone and antenna for wirelessly transmitting the sounds of the baby to a remotely-located parent unit.
Figure 27:
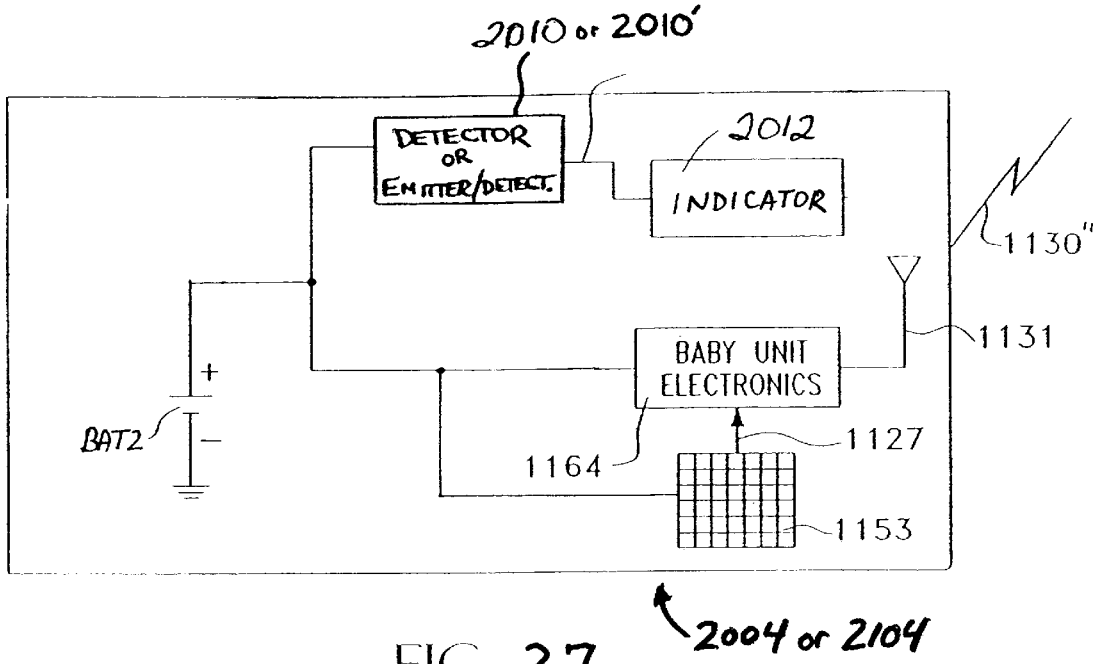
FIG. 27 is a functional diagram of the present invention of FIG. 25 or FIG. 26.

The remotely-located, combined indicator/parent units 1180A, 1180B, 2180A further comprises a conventional plug 1193 that permits these combined indicator/parent units 1180A, 1180B, 2180A to be plugged into any electrical wall outlet (not shown) throughout the home. However, it is within the broadest scope of this invention to include a remotely-located, combined indicator/parent unit 1180A, 1180B and 2180A that are also battery-operated 1300, for example as shown in FIGS. 23–24. For example, the remotely-located, combined indicator/parent unit 1180A or 1180B or 2180A may comprise a portable unit, comprising its own power source 1300 (e.g., a 9 VDC battery, a lithium battery, etc., or any equivalent power source), with the transistor 1167 driving a tactile indicator 1197 (e.g., SU 020S-09170 vibrator device), as shown in FIGS. 23 and 24. Thus, when the indicator receiver 1173 receives the emitted signal 1130 or 1130', the receiver 1173 turns on the transistor 1067 which activates the tactile indicator 1197 which is felt by the parent or caregiver who is wearing (e.g., on the wrist or waist) the portable remotely-located, combined indicator/ parent unit 1180A or 1180B, or 2180A. Thus, when the crib gate 26/136 is detected to be open, the user feels the activation of the tactile indicator 1197.

It should be noted that is also within the broadest aspect of this invention to have the combined gate sensor/baby unit 1122A and 1122B be compatible with a variety of displaceable gate cribs, such as the crib 132 (FIG. 6) having rotatable gate portion 136, as discussed earlier with regard to FIGS. 1–10. Furthermore, the detection of the opened gate 26/136 used in the combined gate sensor/baby unit 1122 (1122A and 1122B) comprises all of the embodiments and variations thereof discussed earlier with respect to the first and second portions 2002/2004 and 2102/2104 disclosed in FIGS. 1–10, such as but not Limited to alignment detection, momentary detection, field disturbance detection as well as the various types of signals that can be used for non-contact detection.

It should be further understood that it is within the broadest scope of the invention to include a digital implementation of the first and second portions 2002/2004 (or 2102/2014), the gate sensor GS and remote indicator RI, and the combined gate sensor/baby unit 1122A/1122B and the combined indicator/parent unit (1180A, 1180B and 2180A) and that the analog implementation is exemplary only.

It should be understood that the baby monitoring system 1120 as shown in FIGS. 13–24 is by way of example only and that like the present invention 2000 shown in FIGS. 1–12D, is not limited to coupling to the crib having the displaceable gate 26 but can be coupled to any crib having a moveable gate and that the first and second portions 2002/2004 (or 2102/2104) of the combined gate sensor/baby unit (1122A/1122B) can be interchanged as discussed previously. Furthermore, as discussed previously with regard to FIGS. 1–12D, the invention of FIGS. 13–24 can also be coupled at a doorway or gate entrance where there is a moveable member, e.g., the door or gate, and a fixed member, e.g., a door frame or gate frame but with the added feature of having the door/gate open indication being provided remotely and wirelessly, along with any audible sounds being made at the door or gate. In addition, the use of the hook-hook means or hook-pile means, discussed earlier, makes the use of the present invention of FIGS. 13–24 easily adaptable at any doorway or gate entrance.

Figure 28:
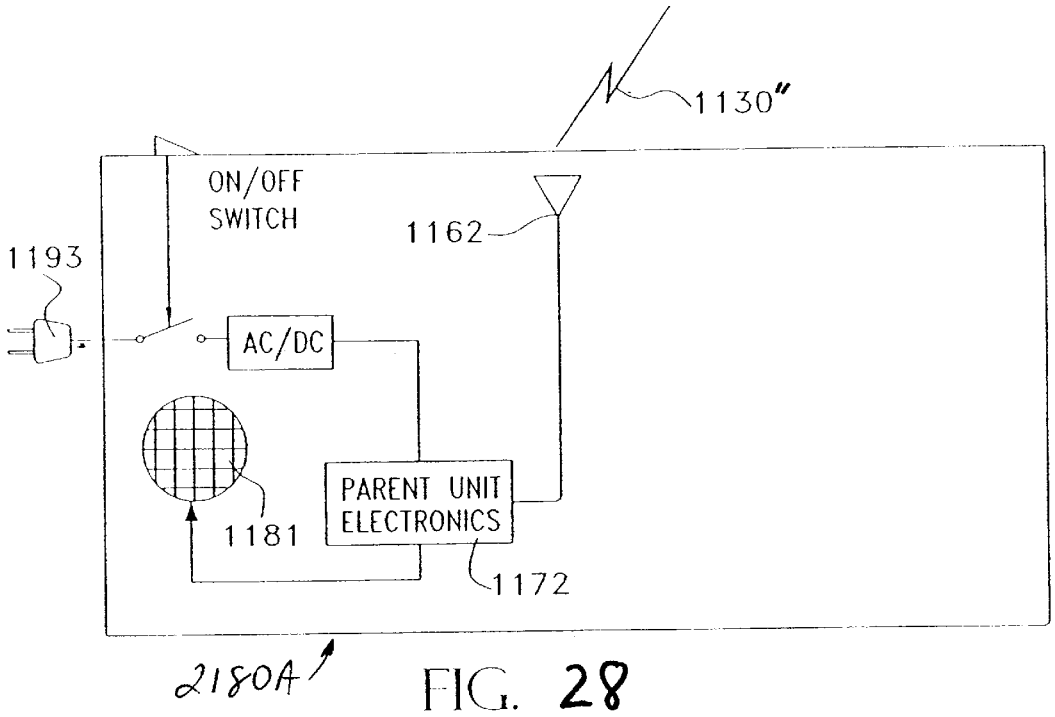
FIG. 28 is a functional diagram of a parent unit used with the present invention of FIG. 25 or 26 for receiving and playing out the baby sounds.

Another variation (FIGS. 25–28) to the baby monitoring system 1120 within the broadest scope of the invention is to include the baby unit electronics 1164/antenna 1131, the microphone 1153 and the indicator 2012 in the second portion 2004/2104 of FIGS. 1–10. Thus, in this configuration, the sounds of the baby are transmitted to a remotely-located parent unit but the crib gate open indication (i.e., indicator 2012) is provided at the crib 22/132 location. In particular, the detector 2010 (FIGS. 25 and 27), or detector 2010' (FIGS. 26 and 27), activates the indicator 2012 whenever a crib gate 26/136 open condition is detected. However, the baby unit electronics 1164/antenna 1131 operate independent of the detector 2010 (or 2010') and therefore transmit the sounds of the baby to the remotely-located parent unit regardless of the condition of the crib gate 26/136. FIG. 28 depicts a functional diagram of the remotely-located parent unit for hearing the sounds of the baby.

TABLE 1

| Item No. | Ref. Symbol | Item Description | Mfg. | Mfg. P/N |
|---|---|---|---|---|
| 1 | R14, 19 | Resistor, 1 K, ¼ W, 5%, CF | | |
| 2 | R15 | Resistor, 560 Ohms, ¼ W, 5%, CF (390 Ohms to adjust emitter drive) | | |
| 3 | R16–17 | Resistor, 100 K, ¼ W 5%, CF | | |
| 4 | R18 | Resistor, 10 K, ¼ W, 5%, CF | | |
| 5 | EMT1 | Emitter, 915 nm, | RS | 276-142 |
| 6 | LED2 | LED, T1¾, Red, Flashing | RS | 276-036 C |
| 7 | D2–3 | Diodes, 1N914 | Generic | 1N914 |
| 8 | VR3 | Pot., 1 M Trimmer | Bourns | 326WW-1-105 |
| 9 | U3 | IC, TS555C, CMOS Timer | Generic | TS555C |
| 10 | U4 | IC, Detector, LM10, CMOS | | LM10 |
| 11 | C7 | Capacitor, 0.1 UF | | |
| 12 | C8 | Capacitor, 0.01 UF | | |
| 13 | C9 | Capacitor, 1 UF, 16 V, Tantalum, dipped | | |
| 14 | BAT2 | battery (e.g., 4 zinc air hearing aid batteries in series) | | #RS675 |
| 15 | | Printed Circuit Board | | |

TABLE 2

| Item No. | Ref. Symbol | Item Description | Mfg. | Mfg. P/N |
|---|---|---|---|---|
| 1 | R1, 3, 4 | Resistor, 1 M, ¼ W, 5%, CF, (R3: 1.8 M Resistor for gain increase) | | |
| 2 | R2, 6, 10 | Resistor, 10 K, ¼ W, 5%, CF | | |
| 3 | R5 | Resistor, 75 K, ¼ W, 5%, CF | | |
| 4 | R7 | Resistor, 10 M, ¼ W, 5%, CF | | |
| 5 | R8 | Resistor, 1 K, ¼ W, 5%, CF | | |
| 6 | R9 | Resistor, 560 Ohms, ¼ W, 5%, CF | | |
| 7 | R11 | Resistor, 1.5 K, ¼ W, 5%, CF | | |
| 8 | R12–13 | Resistor, 100 Ohms, ½ W, 5%, CF | | |
| 9 | VR1 | Pot., 100 K, Frequency Trim | RS | 271-284 |
| 10 | VR2 | Pot, 1 K, Audio Taper, Volume Control | Xicon | 31CC301 |
| 11 | SW1 | Switch, Part of Item 10, On-Off. | Xicon | |
| 12 | LED1 | LED, T1¾, Yellow, Flashing | RS | 276-030 |
| 13 | DET1 | Detector, IR, Photodiode, 914 nm | RS | 276-142 |
| 14 | D1 | Diode, 1N914, glass | Generic | 1N914 |
| 15 | U1 | IC, Comparator, LM358, CMOS | | LM358 |
| 16 | U2 | IC, TS555C, CMOS Timer | Generic | TS555C |
| 17 | Q1 | Transistor, 2N2222 | Generic | 2N2222 |
| 18 | SPK1 | Speaker, 32 Ohm, 0.79", 2 W | Kobitone | 253-5201 |
| 19 | U5 | LM385, 2.5 V Reference | National | LM385z-2.5 |
| 20 | C1 | Capacitor, 1 UF, 16 V, Tantalum, dipped | | |
| 21 | C2, 5 | Capacitor, 0.01 UF, 50 V, Cer. Monolithic | | |
| 22 | C3 | Capacitor, 1 UF, 50 V, Cer. Monolithic | | |
| 23 | C4, 6 | Capacitor, 0.1 UF, 50 V, Cer. Monolithic | | |
| 24 | BAT1 | battery (e.g., 4 zinc air hearing aid batteries in series) | | #RS675 |
| 25 | | Printed Circuit Board | | |

TABLE 3

| Item No. | Ref. Symbol | Item Description | Mfg. | Mfg. P/N |
|---|---|---|---|---|
| 1 | R1–4 | Resistor, 10 K, ¼ W, 5%, CF | | |
| 2 | R5–7 | Resistor, 1 M, ¼ W, 5%, CF | | |
| 3 | R8–10 | Resistor, 150 K, ¼ W, 5%, CF | | |
| 4 | R11 | Resistor, 560 Ohm, ¼ W, 5%, CF | | |
| 5 | R12 | Resistor, 1 K, ¼ W, 5%, CF | | |
| 6 | R13 | Resistor, 1.5 K, ¼ W, 5%, CF | | |
| 7 | R14–15 | Resistor, 100 Ohm, ½ W, 5%, CF | | |
| 8 | R16 | Resistor, 820 Ohm, ¼ W, 5%, CF | | |
| 9 | R17 | Resistor, Variable, 100 K, Trimmer | | |
| 10 | R18 | Resistor, Variable, 5 K, Audio Taper | Xicon | 312-319A-5K |
| 11 | IR1/2 | IR Emitter/Detector | RS | 276-142 |
| 12 | U1 | LM358, Operational Amplifier | National | LM358 |
| 13 | U2 | TS555, CMOS Timer | Mouser | 511-TS555CN |
| 14 | U3 | LM10, Op Amp, Reference | National | LM10 |
| 15 | Z1 | LM385, 2.5 V Reference | National | LM385Z-2.5 |
| 16 | Q1 | Transistor, 2N2222 | Generic | 2N2222 |
| 17 | SPKR | Speaker, 32 Ohm, 0.79", 2 W | Kobitone | 253-5201 |
| 18 | LED1 | LED, Red, T1¾, Flashing | RS | 276-036 |
| 19 | LED2 | LED, Yellow, T1¾, Flashing | RS | 276-030 |
| 20 | SW1 | Switch, Slide | C&K | CKN5000 |
| 21 | BAT1 | Battery, 9 V | | |
| 22 | C1 | Capacitor, 1 UF, 50 V, Ceramic Mono | | |
| 23 | C2 | Capacitor, 1 UF, 50 V, Tantalum | | |
| 24 | C3–4 | Capacitor, 0.1 UF, 50 V, Ceramic Mono | | |
| 25 | C5 | Capacitor, 0.01 UF, 50 V, Ceramic Mono | | |
| 26 | PC1 | Printed Circuit Board | | |

Without further elaboration, the foregoing will so fully illustrate our invention that others may, by applying current or future knowledge, readily adopt the same for use under various conditions of service.

We claim:

1. An apparatus for use with a baby crib having at least one gate that is movable with respect to a crib frame, said apparatus having a first portion mountable to the movable gate and a second portion mountable to the crib frame, said apparatus detecting the open condition of the movable gate without said first and second portions making contact with each other and with one of said portions including an indication of said open condition when said first and second portions are misaligned.

2. The apparatus of claim 1 wherein said first portion comprises an emitter for emitting a signal and said second portion comprises a detector and an indicator, said detector activating said indicator when said detector no longer detects said signal or a portion thereof.

3. The apparatus of claim 2 wherein said signal is an infrared signal.

4. The apparatus of claim 2 wherein said indicator is a visual indicator.

5. The apparatus of claim 2 wherein said indicator is an audible indicator.

6. The apparatus of claim 2 further comprising:

a microphone for converting sounds in the vicinity of the crib into a second signal, said microphone forming a part of said second portion;

a transmitter, coupled to said microphone, for wirelessly transmitting said second signal, said transmitter forming a part of said second portion; and a remotely-located receiver that converts said second signal into sounds when said second signal is received.

7. The apparatus of claim 1 wherein said first portion comprises a detector and an indicator and said second portion comprises an emitter for emitting a signal, said detector activating said indicator when said detector no longer detects said signal, or a portion thereof.

8. The apparatus of claim 7 wherein said signal is an infrared signal.

9. The apparatus of claim 7 wherein said indicator is a visual indicator.

10. The apparatus of claim 7 wherein said indicator is an audible indicator.

11. The apparatus of claim 7 further comprising:

a microphone for converting sounds in the vicinity of the crib into a second signal, said microphone forming a part of said first portion;

a transmitter, coupled to said microphone, for wirelessly transmitting said second signal, said transmitter forming a part of said first portion; and a remotely-located receiver that converts said second signal into sounds when said second signal is received.

12. The apparatus of claim 1 wherein said first portion comprises an emitter for emitting a first signal, a detector for detecting at least a portion of said first signal that interacts with said second portion, and an indicator for indicating an open condition of the moveable gate when said detector no longer detects said at least a portion of said first signal.

13. The apparatus of claim 12 wherein said first signal comprises an infrared signal and wherein said second portion comprises a reflective material for reflecting said at least a portion of said infrared signal towards said detector.

14. The apparatus of claim 13 wherein said indicator is a visual indicator.

15. The apparatus of claim 13 wherein said indicator is an audible indicator.

16. The apparatus of claim 12 further comprising:

a microphone for converting sounds in the vicinity of the crib into a second signal, said microphone forming a part of said first portion;

a transmitter, coupled to said microphone, for wirelessly transmitting said second signal, said transmitter forming a part of said first portion; and a remotely-located receiver that converts said second signal into sounds when said second signal is received.

17. The apparatus of claim 1 wherein said second portion comprises an emitter for emitting a first signal, a detector for detecting at least a portion of said first signal that interacts with said first portion, and an indicator for indicating an open condition of the moveable gate when said detector no longer detects said at least a portion of said first signal.

18. The gate sensor of claim 17 wherein said first signal comprises an infrared signal and wherein said first portion comprises a reflective material for reflecting said at least a portion of said infrared signal towards said detector.

19. The apparatus of claim 18 wherein said indicator is a visual indicator.

20. The apparatus of claim 18 wherein said indicator is an audible indicator.

21. The apparatus of claim 17 further comprising:

a microphone for converting sounds in the vicinity of the crib into a second signal, said microphone forming a part of said second portion;

a transmitter, coupled to said microphone, for wirelessly transmitting said second signal, said transmitter forming a part of said second portion; and a remotely-located receiver that converts said second signal into sounds when said second signal is received.

22. The apparatus of claim 1 wherein said second portion comprises an emitter for emitting a field, a detector for detecting a change in said field by interaction with said first portion, and an indicator for indicating an open condition of the moveable gate when said change in said field is detected by said detector.

23. The apparatus of claim 22 wherein said first portion comprises a conductive material.

24. The apparatus of claim 22 wherein said first portion comprises a dielectric material.

25. The apparatus of claim 22 wherein said first portion comprises a magnetic material.

26. The apparatus of claim 22 further comprising:

a microphone for converting sounds in the vicinity of the crib into a signal, said microphone forming a part of said second portion;

a transmitter, coupled to said microphone, for wirelessly transmitting said signal, said transmitter forming a part of said second portion; and a remotely-located receiver that converts said signal into sounds when said signal is received.

27. The apparatus of claim 1 wherein said first portion comprises an emitter for emitting a field, a detector for detecting a change in said field by interaction with said second portion, and an indicator for indicating an open condition of the moveable gate when said change in said field is detected by said detector.

28. The apparatus of claim 27 wherein said indicator is a visual indicator.

29. The apparatus of claim 27 wherein said indicator is an audible indicator.

30. The apparatus of claim 27 wherein said second portion comprises a conductive surface.

31. The apparatus of claim 27 wherein said second portion comprises a dielectric material.

32. The apparatus of claim 27 wherein said first portion comprises a magnetic material.

33. The apparatus of claim 27 further comprising:

a microphone for converting sounds in the vicinity of the crib into a signal, said microphone forming a part of said first portion;

a transmitter, coupled to said microphone, for wirelessly transmitting said signal, said transmitter forming a part of said first portion; and a remotely-located receiver that converts said second signal into sounds when said signal is received.

34. The apparatus of claim 1 wherein said first portion comprises an emitter for emitting a signal that interacts with said second portion, said second portion comprising an indicator for indicating an open condition of the moveable gate, said indicator being de-activated when said signal interacts with said second portion and being activated when said signal no longer interacts with said second portion.

35. The apparatus of claim 34 wherein said signal is a magnetic field.

36. The apparatus of claim 34 wherein said indicator is a visual indicator.

37. The apparatus of claim 34 wherein said indicator is an audible indicator.

38. The apparatus of claim 1 wherein said second portion comprises an emitter for emitting a signal that interacts with said first portion, said first portion comprising an indicator for indicating an open condition of the moveable gate, said indicator being de-activated when said signal interacts with said first portion and being activated when said signal no longer interacts with said first portion.

39. The apparatus of claim 38 wherein said signal is a magnetic field.

40. The apparatus of claim 38 wherein said indicator is a visual indicator.

41. The apparatus of claim 38 wherein said indicator is an audible indicator.

42. A method for detecting the open condition of a movable gate of a crib having a crib frame, said method comprising the steps of:

coupling a first member to the moveable gate and a second member to the crib frame;

permitting one of said members to detect the presence of the other one of said members without said members contacting each other;

providing an alert indication in one of said members that the gate is open whenever the presence of the other one of said members is no longer detected.

43. The method of claim 42 wherein said step of permitting one of said members to detect the presence of the other one of said members comprises having one of said members emit a signal as well as detect at least a portion of said signal that interacts with said other one of said members.

44. The method of claim 43 wherein said step of providing an alert indication comprises coupling an indicator to said one of said members that detects said at least a portion of said signal and activating said indicator when said portion is not detected by said detector.

45. The method of claim 44 wherein said step of activating said indicator comprises providing a visual indication.

46. The method of claim 44 wherein said step of activating said indicator comprises providing an audible indication.

47. The method of claim 42 wherein said step of permitting one of said members to detect the presence of the other one of said members comprises having one of said members emit a signal and the other one of said members detect at least a portion of said signal.

48. The method of claim 47 wherein said step of providing an alert indication comprises coupling an indicator to said one of said members that detects said at least a portion of said signal and activating said indicator when said portion is not detected by said detector.

49. The method of claim 48 wherein said step of activating said indicator comprises providing a visual indication.

50. The method of claim 48 wherein said step of activating said indicator comprises providing an audible indication.

51. The method of claim 42 wherein said step of permitting one of said members to detect the presence of the other one of said members comprises having at least one of said members emit a field and which detects the presence of the other one of said members when the other one of said members disturbs said field.

52. The method of claim 51 wherein said step of providing an alert indication comprises coupling an indicator to said one of said members that detects said disturbed field and activating said indicator when said portion is not detected by said detector.

53. The method of claim 52 wherein said step of activating said indicator comprises providing a visual indication.

54. The method of claim 52 wherein said step of activating said indicator comprises providing an audible indication.

55. The method of claim 42 wherein said step of permitting one of said members to detect the presence of the other one of said members comprises having one of said members emit a field that interacts with the other one of said members.

56. The method of claim 55 wherein said step of providing an alert indication comprises coupling an indicator to the other one of said members that is activated whenever said field no longer interacts with the other one of said members.

57. The method of claim 55 wherein said field is a magnetic field.

58. The method of claim 55 wherein said step of activating said indicator comprises providing a visual indication.

59. The method of claim 55 wherein said step of activating said indicator comprises providing an audible indication.

60. A method for detecting the open condition of a movable gate of a crib having a crib frame, said method comprising the steps of:

coupling a first member to the moveable gate and a second member to the crib frame;

permitting one of said members to detect the presence of the other one of said members without said members contacting each other;

providing an alert indication in one of said members that the gate is open whenever the presence of the other one of said members is either detected or momentarily detected.

61. An apparatus for use with a baby crib having at least one gate that is moveable with respect to a crib frame, said apparatus comprising:

a first portion mountable to the movable gate;

a second portion mountable to the crib frame, said first and second portions configured to detect the open condition of the moveable gate without contacting each other and when said first and second portions are misaligned;

a transmitter for emitting a wireless signal indicative of the open condition of the moveable gate, said transmitter forming a part of said first or said second portion and being activated by said first or said second portion when the open condition is detected;

a remotely-located receiver that activates a crib gate open indicator whenever said receiver receives said wireless signal; and said first or second portion also including an indication of said open condition when said first and second portions are misaligned.

62. The apparatus of claim 61 wherein said first portion comprises an emitter for emitting an emitter signal and said second portion comprises a detector and said transmitter, said detector activating said transmitter when said detector no longer detects said emitter signal or a portion thereof.

63. The apparatus of claim 62 wherein said emitter signal is an infrared signal.

64. The apparatus of claim 62 wherein said indicator is a visual indicator.

65. The apparatus of claim 62 wherein said indicator is an audible indicator.

66. The apparatus of claim 61 wherein said first portion comprises a detector and said transmitter and said second portion comprises an emitter for emitting an emitter signal, said detector activating said transmitter when said detector no longer detects said emitter signal, or a portion thereof.

67. The apparatus of claim 66 wherein said emitter signal is an infrared signal.

68. The apparatus of claim 66 wherein said indicator is a visual indicator.

69. The apparatus of claim 66 wherein said indicator is an audible indicator.

70. The apparatus of claim 61 wherein said first portion comprises said transmitter and an emitter for emitting an emitter signal, a detector for detecting at least a portion of said emitter signal that interacts with said second portion, and wherein said detector activates said transmitter when said detector no longer detects said at least a portion of said emitter signal.

71. The apparatus of claim 70 wherein said emitter signal comprises an infrared signal and wherein said second portion comprises a reflective material for reflecting said at least a portion of said infrared signal towards said detector.

72. The apparatus of claim 71 wherein said indicator is a visual indicator.

73. The apparatus of claim 71 wherein said indicator is an audible indicator.

74. The apparatus of claim 61 wherein said second portion comprises said transmitter and an emitter for emitting an emitter signal, a detector for detecting at least a portion of said emitter signal that interacts with said first portion and said transmitter, said detector activating said transmitter when said detector no longer detects said at least a portion of said emitter signal.

75. The apparatus of claim 74 wherein said emitter signal comprises an infrared signal and wherein said first portion comprises a reflective material for reflecting said at least a portion of said infrared signal towards said detector.

76. The apparatus of claim 75 wherein said indicator is a visual indicator.

77. The apparatus of claim 75 wherein said indicator is an audible indicator.

78. The apparatus of claim 61 wherein said first portion comprises an emitter for emitting an emitter signal that interacts with said second portion comprising said transmitter, said transmitter being de-activated when said emitter signal interacts with said second portion and being activated when said emitter signal no longer interacts with said second portion.

79. The apparatus of claim 78 wherein said emitter signal comprises a magnetic field.

80. The apparatus of claim 78 wherein said indicator is a visual indicator.

81. The apparatus of claim 78 wherein said indicator is an audible indicator.

82. The apparatus of claim 61 wherein said second portion comprises an emitter for emitting an emitter signal that interacts with said first portion comprising said transmitter, said transmitter being de-activated when said emitter signal interacts with said first portion and being activated when said emitter signal no longer interacts with said first portion.

83. The apparatus of claim 82 wherein said emitter signal is a magnetic field.

84. The apparatus of claim 82 wherein said indicator is a visual indicator.

85. The apparatus of claim 82 wherein said indicator is an audible indicator.

86. A baby monitoring system for use with a baby crib having at least one gate that is moveable with respect to a crib frame, said system comprising:

a first portion mountable to the movable gate;

a second portion mountable to the crib frame, said first and second portions configured to detect the open condition of the moveable gate without contacting each other, said first or second portion generating a first signal indicative of the open condition of the moveable gate;

a microphone for converting sounds in the vicinity of the crib into a second signal, said microphone forming a part of said first or second portion that generates said first signal;

a transmitter, coupled to said microphone, for wirelessly transmitting said second signal, said transmitter also wirelessly transmitting said first signal when generated by said first or second portion; and a remotely-located receiver that converts said second signal into sounds and provides a crib gate open indication when said first signal is also received.

87. The baby monitoring system of claim 86 wherein said first portion comprises an emitter for emitting an emitter signal and said second portion comprises a detector and said transmitter, said detector generating said first signal when said detector no longer detects said emitter signal or a portion thereof.

88. The baby monitoring system of claim 87 wherein said emitter signal is an infrared signal.

89. The baby monitoring system of claim 87 wherein said indicator is a visual indicator.

90. The baby monitoring system of claim 87 wherein said indicator is an audible indicator.

91. The baby monitoring system of claim 86 wherein said first portion comprises a detector and said transmitter and said second portion comprises an emitter for emitting an emitter signal, said detector generating said first signal when said detector no longer detects said emitter signal, or a portion thereof.

92. The baby monitoring system of claim 91 wherein said emitter signal is an infrared signal.

93. The baby monitoring system of claim 91 wherein said indicator is a visual indicator.

94. The baby monitoring system of claim 91 wherein said indicator is an audible indicator.

95. The baby monitoring system of claim 86 wherein said first portion comprises said transmitter and an emitter for emitting an emitter signal, a detector for detecting at least a portion of said emitter signal that interacts with said second portion, and wherein said detector generates said first signal when said detector no longer detects said at least a portion of said emitter signal.

96. The baby monitoring system of claim 95 wherein said emitter signal comprises an infrared signal and wherein said second portion comprises a reflective material for reflecting said at least a portion of said infrared signal towards said detector.

97. The baby monitoring system of claim 96 wherein said indicator is a visual indicator.

98. The baby monitoring system of claim 96 wherein said indicator is an audible indicator.

99. The baby monitoring system of claim 86 wherein said second portion comprises said transmitter and an emitter for emitting an emitter signal, a detector for detecting at least a portion of said emitter signal that interacts with said first portion, said detector generating said first signal when said detector no longer detects said at least a portion of said emitter signal.

100. The baby monitoring system of claim 99 wherein said emitter signal comprises an infrared signal and wherein said first portion comprises a reflective material for reflecting said at least a portion of said infrared signal towards said detector.

101. The baby monitoring system of claim 100 wherein said indicator is a visual indicator.

102. The baby monitoring system of claim 100 wherein said indicator is an audible indicator.

103. The baby monitoring system of claim 86 wherein said first portion comprises an emitter for emitting an emitter signal that interacts with said second portion comprising said transmitter, said transmitter being de-activated when said emitter signal interacts with said second portion and being activated when said emitter signal no longer interacts with said second portion.

104. The baby monitoring system of claim 103 wherein said emitter signal comprises a magnetic field.

105. The baby monitoring system of claim 103 wherein said indicator is a visual indicator.

106. The baby monitoring system of claim 103 wherein said indicator is an audible indicator.

107. The baby monitoring system of claim 86 wherein said second portion comprises an emitter for emitting an emitter signal that interacts with said first portion comprising said transmitter, said transmitter being de-activated when said emitter signal interacts with said first portion and being activated when said emitter signal no longer interacts with said first portion.

108. The baby monitoring system of claim 107 wherein said emitter signal comprises a magnetic field.

109. The baby monitoring system of claim 107 wherein said indicator is a visual indicator.

110. The baby monitoring system of claim 107 wherein said indicator is an audible indicator.

111. An apparatus for use with a baby crib having at least one gate that is movable with respect to a crib frame, said apparatus having a first portion mountable to the movable gate and a second portion mountable to the crib frame, said apparatus detecting the open condition of the movable gate without said first and second portions making contact with each other and with one of said portions providing an indication of said open condition when said gate is moved slightly from a closed position.

112. The apparatus of claim 111 wherein said first portion comprises an emitter for emitting a signal and said second portion comprises an indicator, said indicator activating whenever said signal, or a portion thereof, momentarily interacts with said second portion.

113. The apparatus of claim 111 wherein said first portion comprises an emitter for emitting a signal and said second portion comprises an indicator, said indicator activating whenever said signal, or a portion thereof, interacts with said second portion.

114. The apparatus of claim 113 further comprising:

a microphone for converting sounds in the vicinity of the crib into a second signal, said microphone forming a part of said second portion;

a transmitter, coupled to said microphone, for wirelessly transmitting said second signal, said transmitter forming a part of said second portion; and a remotely-located receiver that converts said second signal into sounds when said second signal is received.

115. The apparatus of claim 111 wherein said first portion comprises an indicator and said second portion comprises an emitter, said indicator activating whenever said signal, or a portion thereof, momentarily interacts with said first portion.

116. The apparatus of claim 111 wherein said first portion comprises an indicator and said second portion comprises an emitter, said indicator activating whenever said signal, or a portion thereof, interacts with said first portion.

117. The apparatus of claim 116 further comprising:

a microphone for converting sounds in the vicinity of the crib into a second signal, said microphone forming a part of said first portion;

a transmitter, coupled to said microphone, for wirelessly transmitting said second signal, said transmitter forming a part of said first portion; and a remotely-located receiver that converts said second signal into sounds when said second signal is received.

118. An apparatus for use with a baby crib having at least one gate that is movable with respect to a crib frame, said apparatus having a first portion mountable to the movable gate and a second portion mountable to the crib frame, said apparatus detecting the open condition of the movable gate without said first and second portions making contact with each other and with one of said portions providing an indication of said open condition, said first and second portions being located out of reach of an infant or toddler in the crib.

119. A method for detecting the open condition of a movable gate of a crib having a crib frame, said method comprising the steps of:

coupling a first member to the moveable gate and a second member to the crib frame;

permitting one of said members to detect the presence of the other one of said members without said members contacting each other;

providing an alert indication in one of said members that the gate is open whenever said first and second members are misaligned.

120. A method for detecting the open condition of a movable gate of a crib having a crib frame, said method comprising the steps of:

coupling a first member to the moveable gate and a second member to the crib frame such that said first and second members are located out of reach of an infant or toddler in the crib;

permitting one of said members to detect the presence of the other one of said members without said members contacting each other;

providing an alert in one of said members that the gate is open whenever said first and second members are misaligned.

121. An apparatus for use with a baby crib having at least one gate that is moveable with respect to a crib frame, said apparatus comprising:

a first portion mountable to the movable gate;

a second portion mountable to the crib frame, said first and second portions configured to detect the open condition of the moveable gate without contacting each other when the gate is moved slightly from a closed position;

a transmitter for emitting a wireless signal indicative of the open condition of the moveable gate, said transmitter forming a part of said first or said second portion and being activated by said first or said second portion when the open condition is detected;

a remotely-located receiver that activates a crib gate open indicator whenever said receiver receives said wireless signal; and said first or second portion also including an indication of said open condition when said first and second portions are moved slightly from a closed position.

122. An apparatus for use with a baby crib having at least one gate that is moveable with respect to a crib frame, said apparatus comprising:

a first portion mountable to the movable gate;

a second portion mountable to the crib frame, said first and second portions configured to detect the open condition of the moveable gate without contacting each other, said first and second portions being located out of reach of an infant or toddler in the crib;

a transmitter for emitting a wireless signal indicative of the open condition of the moveable gate, said transmitter forming a part of said first or said second portion and being activated by said first or said second portion when the open condition is detected; and a remotely-located receiver that activates a crib gate open indicator whenever said receiver receives said wireless signal.

* * * * *